US012643021B2

(12) United States Patent
Cornell et al.

(10) Patent No.: US 12,643,021 B2
(45) Date of Patent: Jun. 2, 2026

(54) GOLF CUP APPARATUS

(71) Applicant: HOLE IQ PTY. LTD., Melrose Park (AU)

(72) Inventors: Philip Cornell, Birdwood (AU); Paul Szuster, Mylor (AU)

(73) Assignee: HOLE IQ PTY. LTD.

( * ) Notice: Subject to any disclaimer, the term of this patent is extended or adjusted under 35 U.S.C. 154(b) by 613 days.

(21) Appl. No.: 18/041,865

(22) PCT Filed: Aug. 19, 2021

(86) PCT No.: PCT/AU2021/050914
§ 371 (c)(1),
(2) Date: Feb. 16, 2023

(87) PCT Pub. No.: WO2022/036402
PCT Pub. Date: Feb. 24, 2022

(65) Prior Publication Data

US 2024/0009531 A1 Jan. 11, 2024

(30) Foreign Application Priority Data

Aug. 21, 2020 (AU) ..... 2020902992

(51) Int. Cl.
*A63B 57/40* (2015.01)

(52) U.S. Cl.
CPC ..... *A63B 57/405* (2015.10)

(58) Field of Classification Search
CPC ..... A63B 57/405; A63B 57/357; A63B 2071/0658; A63B 2071/0694;
(Continued)

(56) References Cited

U.S. PATENT DOCUMENTS 5,125,306 A * 6/1992 Borzym ..... B23D 21/00 269/235
5,362,044 A 11/1994 Hageman
(Continued)

FOREIGN PATENT DOCUMENTS

KR 20-0366634 * 11/2004 ..... A63B 57/405
KR 200366634 Y1 11/2004
(Continued)

OTHER PUBLICATIONS

Mini Billboard Demo, URL: https://www.youtube.com/watch?v=ago0cZIBfrA, published Oct. 30, 2019.

*Primary Examiner* — Michael D Dennis
(74) *Attorney, Agent, or Firm* — Sand, Sebolt & Wernow Co., LPA

(57) ABSTRACT

There is proposed at a golf hole, a golf hole insert or an advertising apparatus, including, a base, a ball support member connected to the base and movable between a retracted position and an elevated position by way of a drive, a generally annular shaped display support fixed to an upper surface of the ball support member whereby, when the ball support member is in the elevated position, the display support extends upwardly from the golf hole above a surface of the golf green for displaying an advertisement. The apparatus further includes a ball guide located within the ball support member for impelling a golf ball received therein into an induced position and a sensor located at, or adjacent, the induced position for controlling the operation of the drive to raise or lower the ball support member depending upon the presence of a golf ball.

11 Claims, 16 Drawing Sheets

(58) Field of Classification Search
CPC ..... A63B 2220/801; A63B 2220/805; A63B 2225/20; A63B 2225/74; A63B 57/40; G09F 9/33; G09F 2013/222; G09F 27/005; G09F 23/0066
See application file for complete search history.

(56) References Cited

U.S. PATENT DOCUMENTS

| | | | | |
|---|---|---|---|---|
| 8,123,015 | B2 * | 2/2012 | Yanai | B25J 19/063 901/29 |
| 2007/0248440 | A1 * | 10/2007 | Andersen | B65G 69/003 414/401 |
| 2009/0305803 | A1 | 12/2009 | Reid | |
| 2018/0207496 | A1 | 7/2018 | Zeidan | |
| 2021/0210469 | A1 * | 7/2021 | Niibori | G09F 9/33 |

FOREIGN PATENT DOCUMENTS

| | | | | |
|---|---|---|---|---|
| WO | 2004020050 | A1 | 3/2004 | |
| WO | WO-2007011159 | A1 * | 1/2007 | A63B 57/405 |
| WO | WO-2008000256 | A1 * | 1/2008 | A63B 57/357 |
| WO | 2008068499 | A1 | 6/2008 | |
| WO | 2009113746 | A1 | 9/2009 | |

* cited by examiner

GOLF CUP APPARATUS

FIELD OF THE INVENTION

The present invention relates generally to a golf cup apparatus and in one aspect to an advertising apparatus or system for a golf cup, or to initiate a predetermined action. In another aspect the invention relates to a golf ball lifting apparatus positionable within a hole in a golf green.

BACKGROUND OF THE INVENTION

There is considerable audience attention on the putt for each hole particularly in high profile golf tournaments, and perhaps more so for the final hole. This presents an opportunity for displaying a message such as an advertising message in connection with the audience focus on the golf hole of the putting green.

Golf holes are formed in a green by cutting out a plug, typically with a 108 mm diameter and to a depth of 100 mm, although some golf holes are formed to a depth of 150 mm. It is usual practice to shift the golf hole of a putting green to prevent undue wear, wherein a new hole is cut and the old hole filled. To provide structural support for the golf hole a golf cup is inserted into the hole. In high profile tournaments a metal golf cup is placed in the hole, to provide a liner for the hole, and a base of the cup having a vertical aperture, in which a flagstick can be supported. Drain holes are also formed through the base so that the cup does not fill with water. Plastic golf cups are also used in other tournaments and are available commercially.

The prior art includes a number of proposed advertising methods for golf cups, comprising a fixed insert within the cup, including those described in U.S. Pat. Nos. 6,712,714, 6,676,531, 5,788,581, 5,362,044, 5,351,950, 5,249,384, and 4,878,665. These fixed displays are visible principally by persons on the green in the vicinity of the golf hole, for example, the player or caddy retrieving the ball, and as such do not provide an effective display for a wider audience. The use of such displays for advertising purposes is therefore limited in its reach.

Two suggestions have been made in the prior art for advertising displays on automated ball retrievers associated with golf cups in published patent specification WO2004020050 and WO2007011159. These two suggested structures are of a complex and fragile construction requiring multiple telescoping components to elevate a ball cradle or holder well above the ground for ease of retrieval of the ball and at the same time providing for a display useful for advertising purposes. The ball cradle is raised well above the ground surface and therefore a users foot or other items could be caught between the underside of the ball cradle and the ground surface when the cradle is lowered. Therefore, practically the proposed devices are unsuitable for use in a golf course situation and pose an injury risk to users.

Another issue with existing golf holes is that players can damage the grass surrounding the top of the hole, for instance by using their club to retrieve the ball from within the hole. Furthermore, at times it is difficult for older players to retrieve the ball from within the hole.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

It is therefore an object of the present invention to provide an advertising apparatus or system for a golf hole and/or to provide a ball lifting device. Other objects of the illustrated embodiments are to overcome at least some of the aforementioned problems, or at least provide the public with a useful alternative. The foregoing objects should not necessarily be considered as cumulative and various aspects of the invention may fulfil one or more of the above objects.

The invention could broadly be understood to comprise an apparatus positionable within a hole on a golf green for providing advertising, being either physical printed advertising or virtual advertising or a combination thereof. In another aspect of the invention there is provided a lifting apparatus for a golf ball to assist with retrieval thereof from within a golf hole.

In one aspect of the invention, but not necessarily the broadest or only aspect, there is proposed an advertising apparatus, including:

- a base being supportable within a golf cup or forming a part thereof, the golf cup being positionable within a golf hole of a golf green;
- a ball support member connected to the base and movable between a retracted position and an elevated position by way of a drive;
- a generally annular shaped display support fixed to an upper surface of the ball support member whereby when the ball support member is in the elevated position the display support extends upwardly from the golf hole above a surface of the golf green;
- a ball guide located within the ball support member for impelling a golf ball received therein into an induced position; and
- a sensor located at, or adjacent, the induced position for controlling the operation of the drive to raise or lower the ball support member depending upon the presence of a golf ball.

The display support can be moved from a retracted position wherein it is substantially below a putting surface, into an elevated position wherein the display support extends upwardly from the top of the golf cup, thereby providing a display that is viewable above the golf green surface.

In one form, the display support comprises a vertically planar strip of material which is wrapped to form a circular portion and attached to the ball support member, wherein an advertisement is printed on to the strip of material, or affixed thereto, or the advertisement is projected thereonto.

Preferably when the golf ball activates the sensor the ball support member is moved from the retracted position into the elevated position to thereby present the display support above a surface of the golf green. When the golf ball is removed from within the ball support member the sensor activates the drive to move the ball support member from the extended position into the retracted position, wherein the display support is located substantially within the golf cup and below the surface of the golf green.

The activation of the sensor may also control other external devices, such as but not limited to a range finder, audio device, audio-visual device, or it may cue other advertising, such as animations or super imposed advertising to be presented on a broadcast feed, or it may initiate another predetermined action.

A control member may be attached to the base and coupled to the drive. The control member may preferably be an electric motor powered by an integrate power source.

The sensor may preferably be coupled to an actuator to provide a signal to activate the control member on the ball entering the golf cup to thereby operate the drive.

The sensor may comprise a contact sensor whereby contact with the ball provides a signal to the actuator to operate a motor to elevate the ball receiving member. Alternatively, the sensor may be, for example, a light beam source and a light detector, whereby on the ball entering the golf cup, the light beam is interrupted whereupon a signal is sent to the actuator to operate the motor.

In the case of an electric motor the apparatus preferably further comprises a return switch means, to signal or act on the actuator to reverse the motor to thereby retract the ball support member when the ball is removed.

When the ball support member is in the elevated position the outwardly facing peripheral of the display support extends above a top of the golf cup and surface of the golf green. This arrangement provides for a display support where in the elevated position, the display is positioned above a golf green surface with indicia on, or projection onto, the display support being visible laterally from an outside of the golf hole and thus being readily seen and shown, for example, by spectators or a television audience.

The ball support member in one form includes an upper portion that protrudes above the golf cup when in the elevated position, wherein the upper portion forms the display support. In another form the display support is removably attached to an upper part of the ball receiving member.

Indicia may be attachable to the display support to provide adverting, or the display support may itself comprise the advertising. For instance, the display support may include a strip of plastics material that has advertising printed directly thereon, or the advertising may comprise a printed sticker that is secured to a blank display support, different shaped displays may also be used. Preferably the advertising may be easily changed or altered.

It will be understood that there are several other options for the display. Thus for example the advertising or display may comprise a plurality of Light Emitting Diodes (LEDs) or similar lighting to provide either a dynamic display or a static display. The dynamic display might thus vary the message or at least attract more attention than a static display.

The LED display may be coupled to the same power supply as the motor, thus the LED display may be coupled to a battery housed in the base of the apparatus.

The message displayed may optionally be selected remotely, whereby a message selecting transmitter can signal to a message selecting receiver on the apparatus, to select the message to be displayed.

In the alternative the display may be printed on card or formed into plastics which display may be inserted into suitable retention device on the display support or simply be fastened to the display support.

In still another form the display support may include a blue screen or similar coloured surface used in visual effects techniques, wherein advertising is virtually overlayed thereon within the broadcast environment.

The ball support member in one form has a generally circular outer peripheral wall that is dimensioned to be slidably positioned within the golf cup. Preferably, the ball support member has a close fit with the golf cup to inhibit debris from being caught between the outer peripheral wall of the ball support member and the inner surface of the golf cup.

It should be appreciated that the outer peripheral wall of the ball support member slidably engages or is spaced apart from the inner surface of the golf cup provided it fits closely within the golf cup. Although the internal diameter of golf cups can vary, the regulation golf cup is 10.795 cm (4.25-inch) external diameter. Accordingly, the diameter of the ball support member may be between 10.5 cm and 10.794 cm.

The ball support member preferably has vertical void or voids therethrough to permit the passage of water.

The base preferably includes an upwardly projecting column which slidably supports an elevatable member thereon. The elevatable member is rigidly fixed to a lower part of the ball receiving member.

In one form the drive comprises a first arm that is rigidly connected at a first end to a rotatable mount on the control member and pivotably connected to a second arm at a second end thereof. A second end of the second arm is likewise pivotably connected to a fixed mounting point on the elevatable member.

Alternatively, the ball support member and elevatable member are unitary in construction and the second end of the second arm is connected thereto.

In use as the rotatable mount of the control member is moved, the first arm is pivoted which in turn pivots the second arm to thereby either raise or lower the ball receiving member.

The ball support member preferably includes a central aperture to allow for passage of a regulation sized flagstick, so that it can be passed therethrough and inserted into the flagstick aperture in the golf cup. Alternatively, the central aperture may be configured to support the flagstick, whereby when the ball support member is moved into the elevated position the flagstick is also moved upwardly.

Typically the top of the golf cup is set below the putting surface and golfing regulations stipulate that the top of the golf cup should be a minimum of 25.4 mm (1 inch) below the surface of the green. Accordingly, it will be understood by the reader that the elevation of the display support upwardly of the top of the golf cup is such that it extents at least partially above the putting surface. In one form the display support has a lowermost portion that extends at least 25.4 mm (1 inch) above the top of the golf cup. The total height of the display portion may be between 40-50 mm.

The height to which the display support can be elevated can be adjusted to compensate for the distance between the playing surface and the top of the golf cup, or to compensate for the actual depth of the golf cup.

The amount of elevation may be set prior to elevation within a specific range, the elevation being set once inserted into a particular golf cup (where the apparatus is not part thereof) in a particular golf hole so that the elevation of the display support is always the same irrespective of the depth of the hole, unless it is reset. When the same apparatus is positioned in another golf hole the extent of elevation can be reset.

In one form the base of the apparatus is shaped to contact an upwardly facing surface of the interior of the golf cup. Upright contact surfaces of the base are shaped to closely fit to two or more opposing upright surfaces of the interior of the golf cup. The upright contact surface of the base and golf cup provide for lateral stability of the apparatus. The upright contact surface of the golf cup may be sides of the liner, or inner sides of the drain holes in the golf cup.

The base is preferably complementary in shape to the general shape of the lowermost portion of a golf cup. For instance, the shape may comprise cylindrical side walls and an inverse cone shaped base. The flagstick aperture may be at the bottom of the golf cup and in one for a central aperture of the ball support member coaxially aligns the flagstick aperture. Furthermore, the base of the apparatus also includes a central aperture that permits passage of the flagstick therethrough.

In one form the drive comprises an arm or arm members. Alternatively, the drive may comprise at least one rack and pinion, or at least one biasing spring having a stop to limit the elevation of the display support, and a catch means to capture the display support to move it into the retracted position against the bias of the spring. Furthermore, the drive may be a screw threaded member, such that the motor rotates the rotatable screw threaded member to thereby provide the elevation.

The motor may comprise a water proof enclosure to inhibit damage from the ingress of water. In this embodiment the apparatus preferably further includes a battery to power the motor. Alternatively, the motor is connected by wires to an external power source, such as but not limited to a photovoltaic array.

The display support may be elevated in a vertical direction either directly or the display support may be rotate between the retracted and extended positions.

The reader should appreciate that the apparatus can be fitted to or positionable within a conventional golf cup. In another aspect the invention could be understood to encompass a golf cup with an automatically elevatable display support. Thus, the invention provides a golf cup for insertion into a golf hole cut in a playing surface comprising a base, a liner and an elevatable display support. The elevatable display support being movable between a retracted position and an elevated position, wherein when in the elevated position the display support extends upwardly from within the golf hole above a surface of the playing surface, when a ball enters the golf cup.

In another aspect of the invention the advertising may be virtual advertising that is displayed in proximity to a golf hole on a display screen, when a golf ball enters the golf cup. This advertising is therefore able to be incorporated into the televised broadcast footage for display on televisions and display screens.

In the immediately preceding apparatus including:

- a sensor located within a golf cup in a golf course green and configure to register a presence of a golf ball within the golf cup;
- a transmitter for transmitting a signal;
- a processing unit for receiving the signal and overlaying an image over video footage of the golf course green; and
- a broadcast unit for broadcasting the video footage with the overlayed image for viewing.

The image may be a static image, a series of images or an overlaying video image on the video footage of the golf course green.

The apparatus may include a sealed push button switch with rubber boot, for turning the apparatus on/off or to change modes of operation. The modes of operation may include, but not limited to, the ball support member remaining in a raised position until a golf ball is removed, and the ball support member moving up and remaining in a raised position for a set period of time whereafter it moves back into the lowered position, with the golf ball remaining therein. The apparatus may further include a recharge port, including but not limited to, a USB recharge port.

The drive in a preferred form includes an overload mechanism comprising a decouplable arm portion, which is coupled to a rotary body. The decouplable arm portion may include a primary portion which includes a first magnet, and a secondary portion which includes a second magnet. When sufficient downward pressure is applied to the ball support member or display support, the magnetic attraction between the first and second magnets is overcome and the primary portion is triggered to detach from the secondary portion and move into the lowered position independently of the secondary portion. A dampening device may be used to control the independent rotation of the primary portion around the rotary body when detached from the magnet of the secondary portion.

In another aspect of the invention there is proposed a method of presenting adverting adjacent a golf cup when a golf ball is retained therein, including the steps of:

- providing a sensor in the golf cup, configured to determine the presence of a golf ball therein; and
- activating a physical adverting member or presenting virtual advertising overlaying a broadcast image when the golf ball is positioned within the golf cup.

Preferably, the processing unit includes a central processing unit (CPU) and a graphics user interface (GUI).

In still yet another aspect of the invention there is proposed a software program for controlling the operation of any of the preceding apparatus and for the application of the preceding method.

The software program may be implemented as one or more modules for undertaking the steps of the present invention. The modules can be packaged functional hardware units for use with other components or modules. Multiple central processing units (CPU) may be used to control the operation of the apparatus. For instance, the apparatus contained within the golf cup may include a designated CPU and a television broadcast controller may include a separate CPU.

Some of the components of the apparatus may be connected by way of a communication device such as, but not limited to, a modem communication path, a computer network such as a local area network (LAN), Internet, or fixed cables.

In one form the broadcast control device includes a computer having memory in the form of random access memory (RAM) and read-only memory (ROM), a central processing unit or units, input/output (IO) interfaces and at least one data storage device.

The processor and the memory cooperate with each other and with other components of a computer to perform all of the functionality described herein. In another form the processor executes appropriate software to perform all of the functionality described herein. In an alternate form, some of all of the functionality described herein can be accomplished with dedicated electronics hardwired to perform the described functions.

Application software may be stored in a computer readable medium on a storage device such as a hard drive, a magneto-optical disk drive, CD-ROM, integrated circuit, a radio or infra-red transmission channel between the computer and another device, a computer readable card such as a PCMCIA card, a flash drive or any other of the number of non-volatile storage devices. The foregoing is merely exemplary of relevant computer readable mediums. Other computer readable mediums may be practiced without departing from the scope of the invention.

In another form the apparatus includes embedded software or firmware with corresponding hardware that is designed to perform one or more dedicated functions of the present invention.

Preferably, a video broadcast will be sent over a network, such as but not limited to a digital television network or satellite network to television screens.

It is envisaged that the signal sent by a transmitter is within a different frequency than the signal sent by the broadcast unit. For instance, broadcast television is typically within the UHF range between 300-3000 MH and therefore the signal sent by the data logger could be within the HF range (3-30 MHz) used for shortwave communication or the EHF range (30-300 GHz) used for microwave data links or the 0.9-5.6 Ghz range for WiFi or Bluetooth® short range communication.

In one form the information is transmitted to a television broadcast controller for display on the video display screen such as large screens at sporting venues or broadcast via the television or telecommunications network for viewing at a site remote from the venue or in the case of mobile phones at the venue to augment the viewing experience.

In still another aspect of the invention there is proposed a ball raising assembly for a golf cup, including:

- a sensor located within the golf cup and configure to register a presence of a golf ball within the golf cup;
- a ball support member located within the golf cup and being movable between a retracted position and an elevated position by way of a drive; and
- an actuator for operating the drive when a signal is received from the sensor, to thereby raise the golf ball, whereby it can be retrieved by a user or may be configured to expel the golf ball out of the golf cup.

Preferably when the golf ball activates the sensor the ball support member is moved from the retracted position into the elevated position to thereby expel the golf ball from the golf cup or to present the golf ball in a location where it can be grasped by the player. When the golf ball is expelled or removed from within the ball support member the sensor activates the drive to move the ball support member from the extended position into the retracted position. A mechanical switch may be used to terminate the lowering of the ball support member, when it lowers to a predetermined depth.

A control member, such as an electric motor, may be attached to the ball support member and coupled to a drive. In the case of an electric motor the apparatus preferably further comprises a return switch means, to signal or act on the actuator to reverse the motor to thereby retract the ball support member when the ball is removed.

The sensor is preferably coupled to an actuator to provide a signal to activate the control member upon the ball entering the golf cup to thereby operate the drive. The sensor may comprise a contact sensor whereby contact with the ball provides a signal to the actuator to actuate a motor to elevate the ball receiving member.

Alternatively, the sensor may be, for example, a light source and a light detector, and on the ball entering, the light beam is interrupted whereupon a signal is sent to the actuator to actuate the motor. Still alternatively, an optical distance measuring sensor may be used to determine the location or absence of the ball.

The ball support member preferably has vertical void or voids therethrough to permit the passage of water.

BRIEF DESCRIPTION OF THE DRAWINGS

The accompanying drawings, which are incorporated in and constitute a part of this specification, illustrate an implementation of the invention and, together with the description and claims, serve to explain the advantages and principles of the invention. In the drawings.

DETAILED DESCRIPTION OF THE ILLUSTRATED AND EXEMPLIFIED EMBODIMENTS

Figure 1:
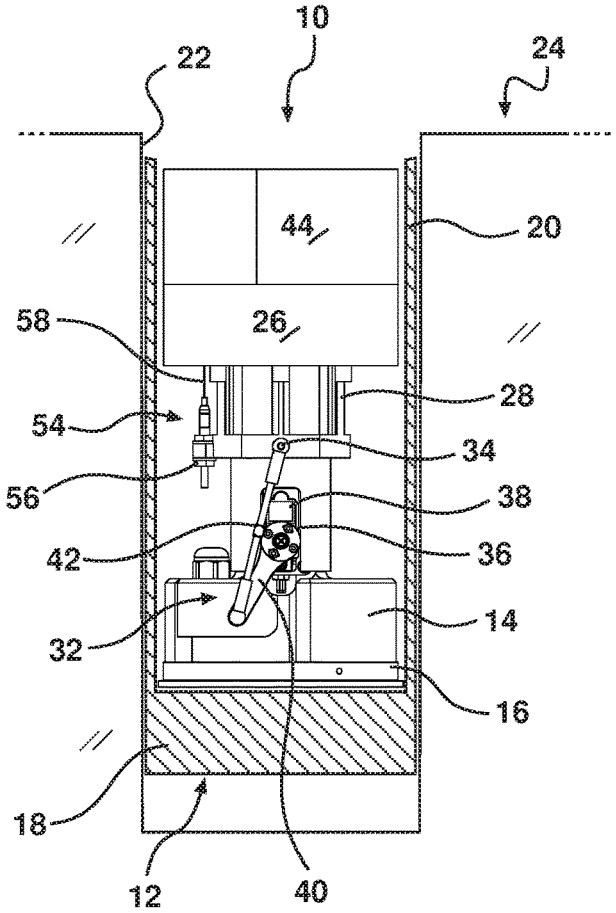
FIG. 1 is a side schematic view of one embodiment of an advertising apparatus of the present invention, illustrating the display support in a retracted position.

Similar reference characters indicate corresponding parts throughout the drawings. Dimensions of certain parts shown in the drawings may have been modified and/or exaggerated for the purposes of clarity or illustration.

Referring to the drawings for a more detailed description, an advertising apparatus 10 positionable within a golf cup 12 or forming part thereof is illustrated, demonstrating by way of examples, arrangements in which the principles of the present invention may be employed. As illustrated in the figures the apparatus 10 includes a base 14 having a foot 16 that is configured to rest on the top of a baseplate 18 of the golf cup 12. The golf cup 12, includes the baseplate 18 and a cylindrical liner 20, and is locatable within a hole 22 that is cut in the playing green 24. As illustrated in FIG. 1, the top of the golf cup 12 is positioned below and spaced apart from the playing green 24.

The apparatus 10 further includes a ball support member 26 that is rigidly fixed to an elevatable member 28. The elevatable member 28 slidably engages column 30 that extends upwardly from the base 14. A drive 32 is connected to fixed mounting point 34 on the elevatable member 28 and a rotatable mount 36 on the control member 38 being in the present embodiment an electric motor. In the present embodiment the drive 32 comprises a first arm 40 and a second arm 42, wherein the first arm 40 is rigidly connected at a first end to the rotatable mount 36 on the control member 38 and pivotably connected to the second arm 42 at a second end thereof. A second end of the second arm 42 is pivotably connected to the fixed mounting point 34.

The reader should appreciate that the motor 38 is connect to a power source such as but not limited to a battery (not shown).

A generally annular shaped display support 44 is fixed to the ball support member 26 and extends upwardly therefrom. The display support 44 is illustrated in the figures as being generally blank, however it should be appreciated that indicia will be applied to or incorporated into the display support 44 for advertising or display purposes. For instance, an advertisement or corporate logo may be applied to or printed onto the display support 44 to promote the goods or services of a trader. Furthermore, although not illustrated, the display support may include illuminated display means such as, but not limited to, LED lights or other illumination means.

Figure 2:
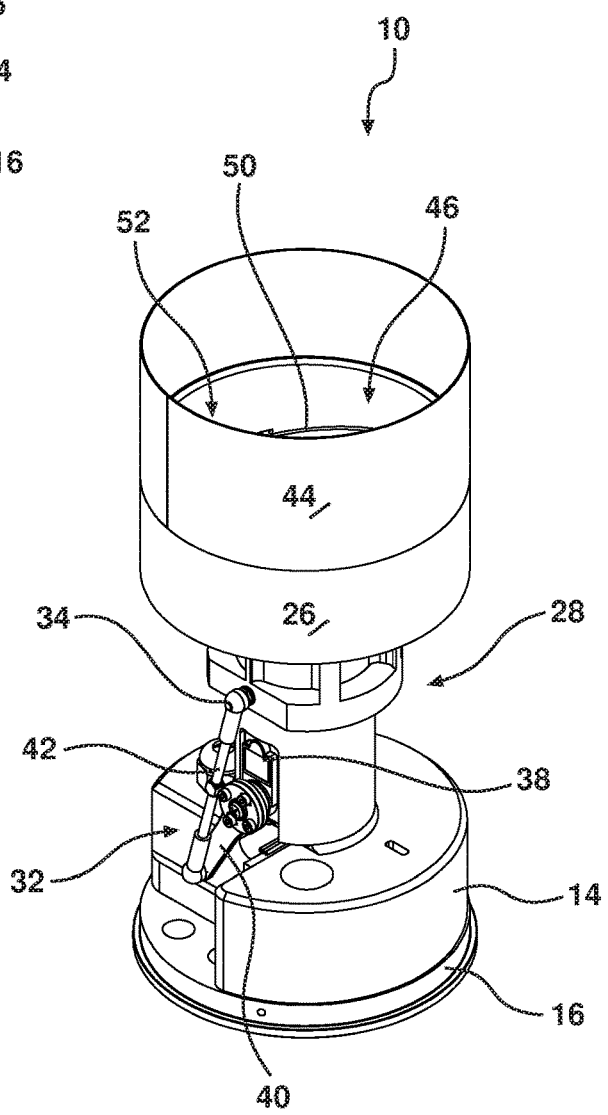
FIG. 2 is a perspective view of the advertising apparatus of FIG. 1 in isolation from the golf cup.
Figure 3:
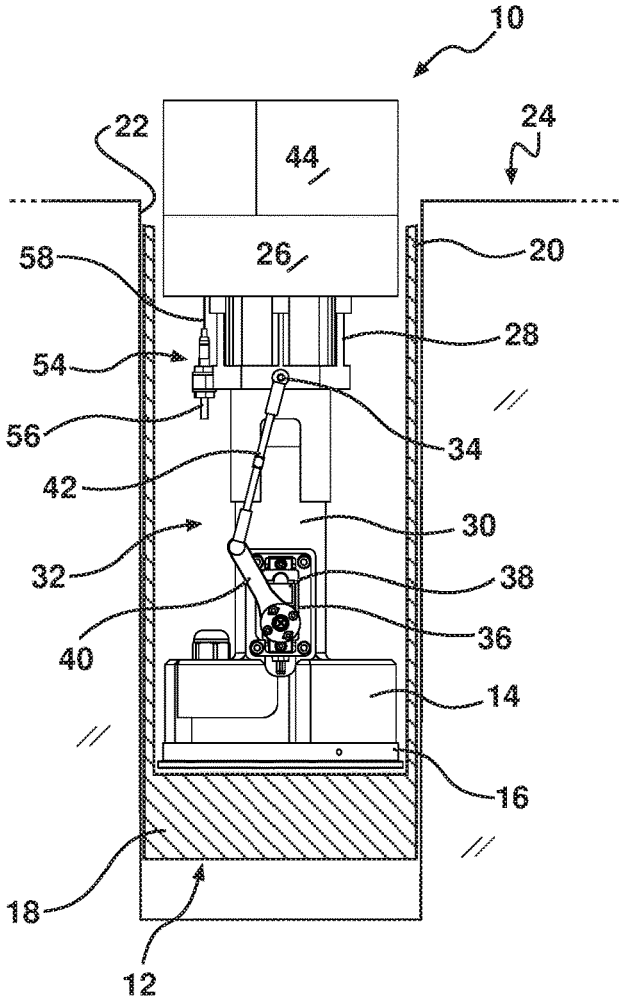
FIG. 3 is a side schematic view of the advertising apparatus of FIG. 1, illustrating the display support in an extended position.
Figure 4:
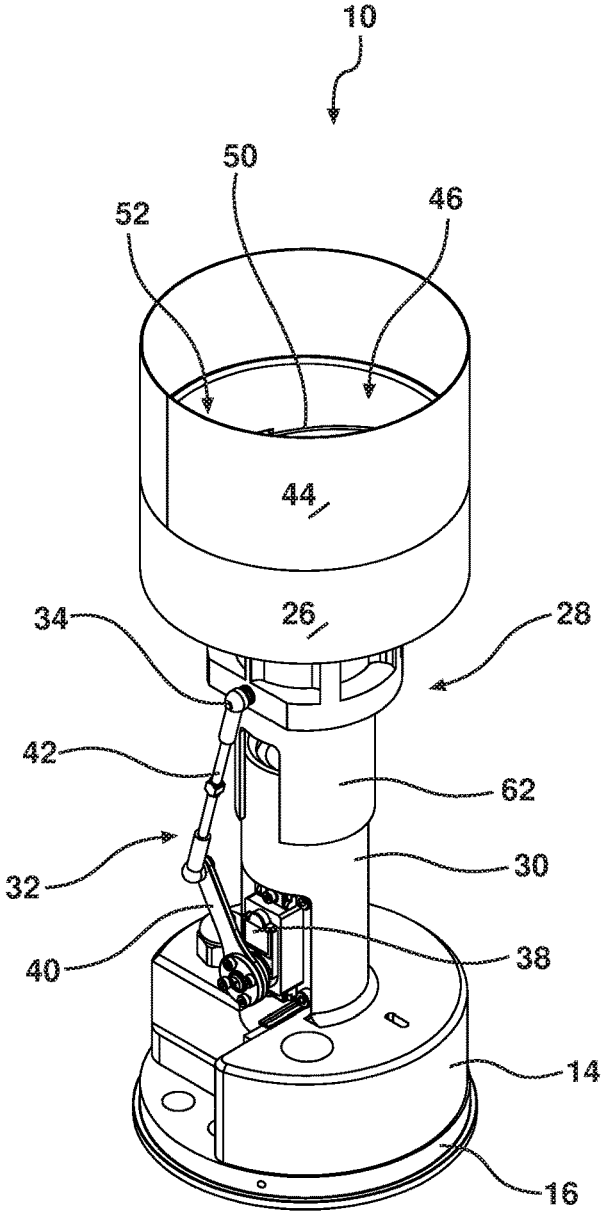
FIG. 4 is a perspective view of the advertising apparatus of FIG. 3 in isolation from the golf cup.

In the present embodiment the ball support member 26, elevatable member 28 and display support 44 are all movable between a retracted position as illustrated in FIGS. 1 and 2, and an elevated position as illustrated in FIGS. 3 and 4. When the display support 44 extends upwardly from the golf cup 12 the advertising on the outer surface of the display support 44 can be viewed from a side and at a distance from the golf cup 12, to thereby increase exposure of the adverting or display.

As illustrated in FIG. 2 the ball support member 26 includes an upwardly facing chamber 46 for receiving a golf ball 48 therein. The ball support member 26 includes a ball guide 50 that impels the golf ball 48 into an induced position 52 whereby it comes into contact with or activates a sensor 54, which in the present embodiment is a contact sensor 54 that include a body 56 and vertical contact shaft 58.

The drive 32 is configured to move the display support 44 between the retracted position as illustrated in FIGS. 1 and 2 wherein the display support 44 is positioned within the golf cup 12, and the elevated position as illustrated in FIGS. 3 and 4 wherein the display support 44 extends upwardly from the top of the golf cup 12 such that it is positioned substantially above the playing green 24, as illustrated FIG. 3. In this way the advertising on the display support 44 can be viewed at a distance from the golf hole 22, which has advantages for brand promotion to the viewers present in the gallery and broadcast coverage of golfing events. The advertisement may also be projected into the display support 44 for viewing by the broadcast audience.

The sensor 54 controls the operation of the drive 32 to change the position of the display support 44 depending upon the presence or absence of a golf ball 48 within the ball support member 26.

Figure 5:
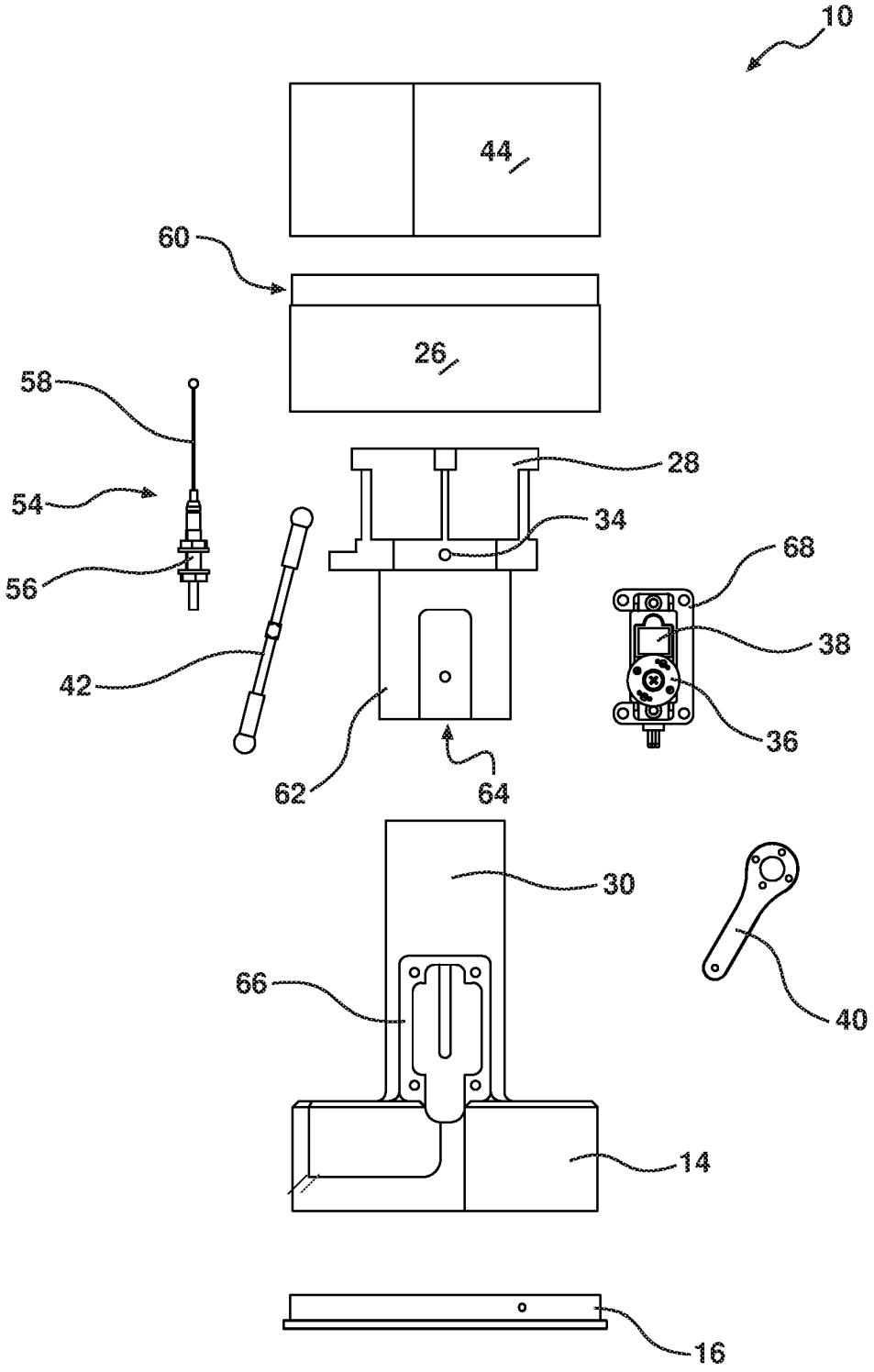
FIG. 5 is an exploded view of the advertising apparatus of FIG. 1.

FIG. 5 is an exploded view of the apparatus 10 illustrating the various components. As illustrated in FIG. 5, the ball support member 26 includes an annular step 60 that is used for the attachment of the display support 44 thereto. In this way the outer perimeter of the ball support member 26 and adjoining display support 44 is generally uniform, as illustrated in FIGS. 1 to 4. This means that there is no ridge or lip created when the display support 44 is attached, which could be caught or jammed against the top edge of the golf cup 12 in use.

The elevatable member 28 includes a depending sleeve 62 that fits over the column 30. The sleeve 62 includes a recess 64 that accommodates the motor 38 when the elevatable member 28 is in the retracted position.

As further illustrated in FIG. 5, the base 14 include a mount 66 for attachment of the motor frame 68 thereto.

It will be appreciated by the skilled addressee that the fixing means, such as screw, bolts and nuts, used in the assembly of the apparatus are not illustrated. Furthermore, although the display support 44, ball support member 26, and elevatable member 28 are illustrated as being individual components, the reader will appreciate that all or some of them may be unitary in construction without departing from the scope of the invention.

Figure 6:
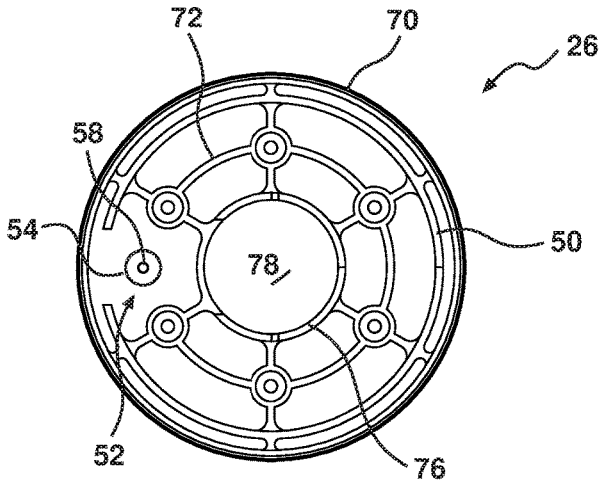
FIG. 6 is a top view of the ball support member illustrating the position of the sensor.
Figure 7:
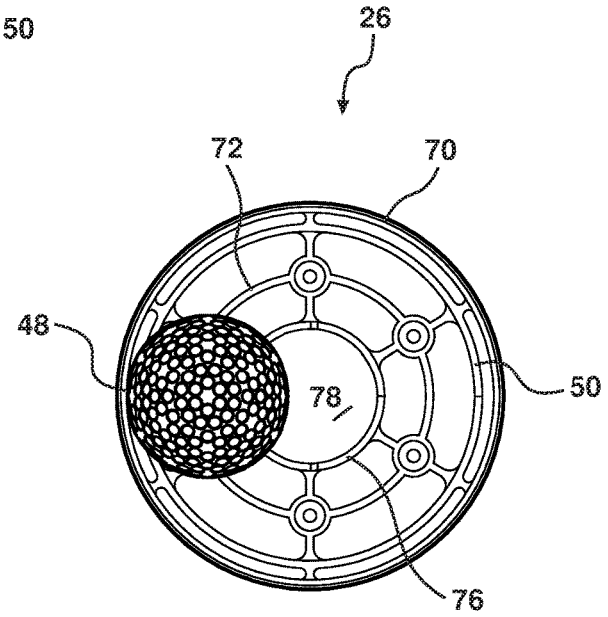
FIG. 7 is a top view of the ball support member of FIG. 6 illustrating the induced position that the ball is impelled into.

FIG. 6 illustrates the ball support member 26 comprises an annular upwardly extending wall 70 forming the upwardly facing recess 46, a web portion 72 generally defining a bottom of the ball support member 26, the outer guide member and an inner guide member 76 that both extend upwardly from the web portion 72 and are configured to control movement of the golf ball 48 once it enters the ball support member 26, such that the golf ball 48 is urged into the induced position 52.

As further shown in FIG. 6, the sensor 54 is positioned adjacent the induced position 52 whereby the vertical contact shaft 58 is contacted by the golf ball 48 when it is moved into the induced position 52 by the guide members 50, 76.

Figure 8:
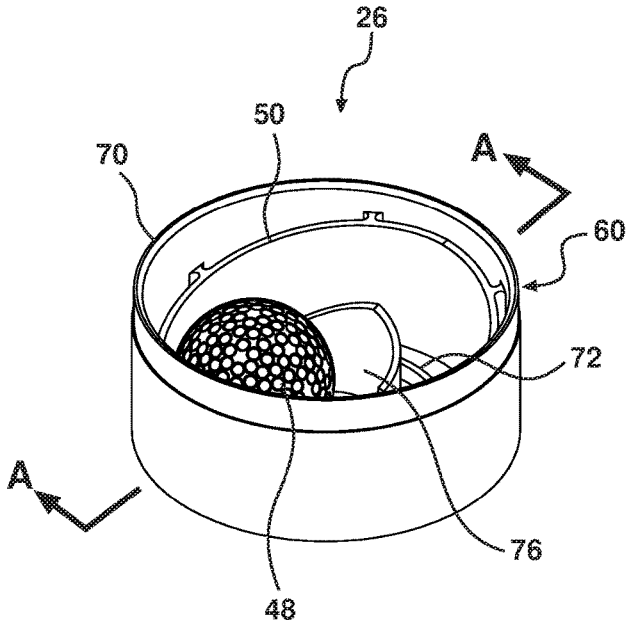
FIG. 8 is a perspective view of the ball support member of FIG. 7 illustrating the inclined guide within the ball support member and position of the golf ball.
Figure 9:
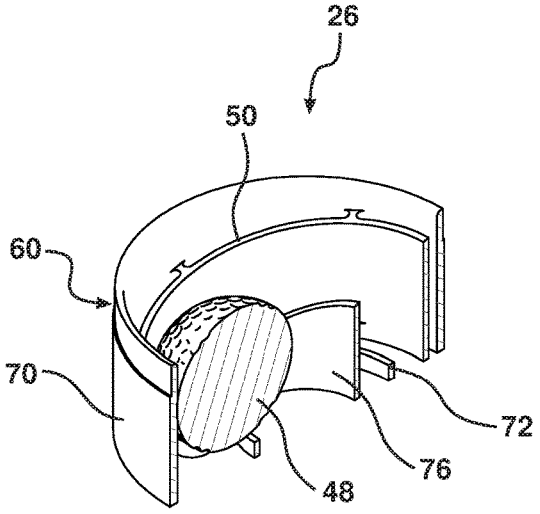
FIG. 9 is a cross section view through A-A of FIG. 8.

As illustrated in FIGS. 8 and 9, the guide members 50, 76 are sloped such that the ball rolls under the influence of gravity into the lowest position, which corresponds to the induced position 52.

The ball support member 26 includes a central aperture 78 that is configured to allow the passage of a flagstick 90 therethrough as will be discussed with respect to FIG. 11.

Figure 10A:
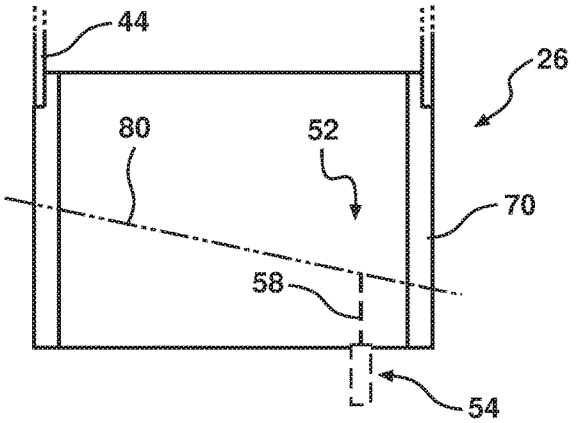
FIG. 10*a* is a side schematic view of the ball support member illustrating the plane of one embodiment of the inclined guide with a single sensor.

FIG. 10*a* illustrates the above embodiment wherein the upper surface of the guide members are positioned along a single plane 80 as indicated by the broken line. The sensor 54 is positioned at a lower region of the plane 80, wherein the contact shaft 58 can be contact by the golf ball 48 when in the induced position 52.

Figure 10B:
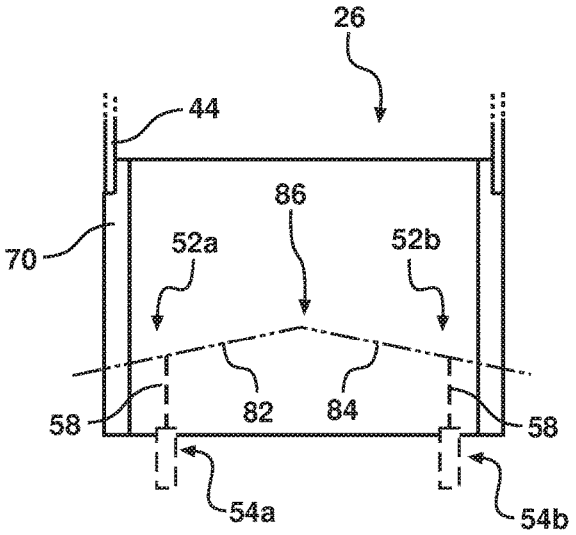
FIG. 10*b* is a side schematic view of another embodiment of the ball support member having inclined guides having different planes of inclination that join at an apex and two sensors.

In another embodiment as illustrated in FIG. 10*b*, the different section of the guide member or members is/are positioned along planes 82 and 84 that join at apex 86 as indicated by the broken lines. In the immediately preceding embodiment the guides form two induced positions 52*a*, 52*b*. Correspondingly positioned sensors 54*a*, 54*b* are located at, or adjacent, respective induced positions 52*a*, 52*b*.

Figure 11:
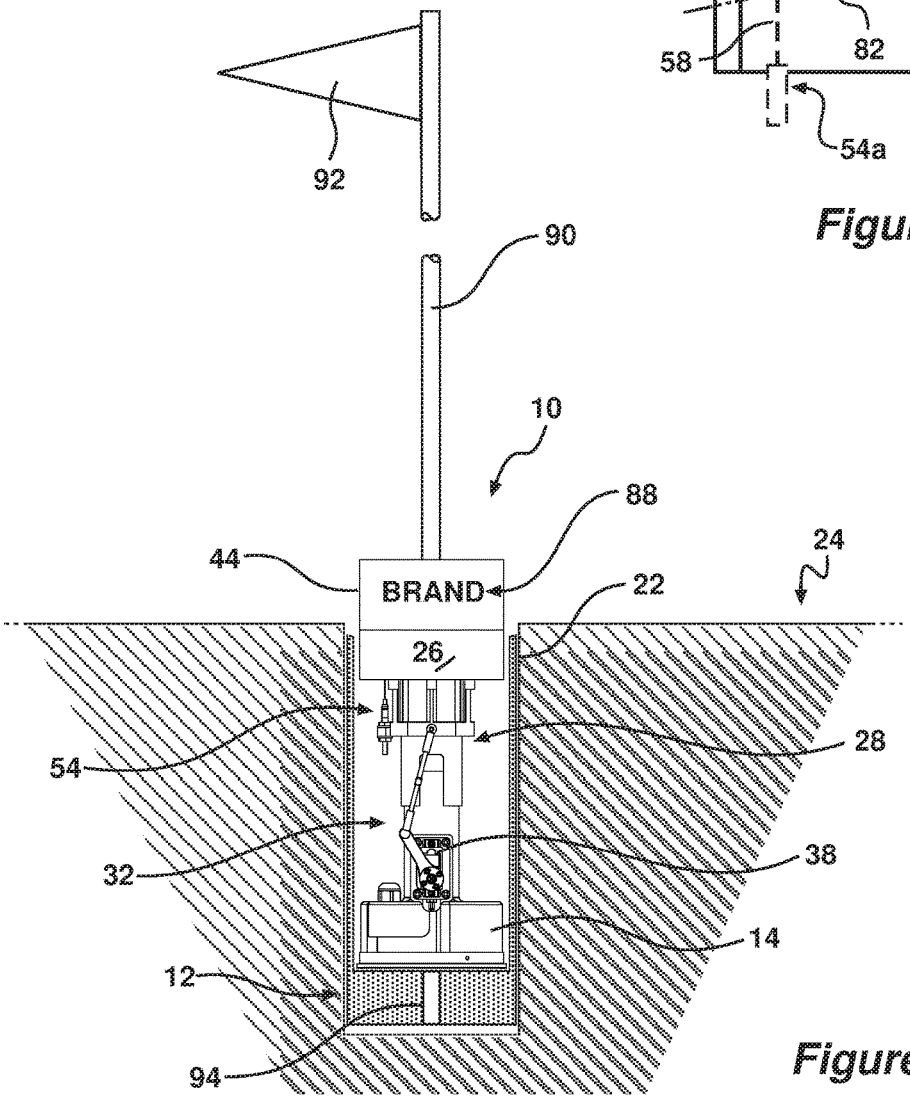
FIG. 11 is a side schematic view of the advertising apparatus of FIG. 3 illustrating the positioning of the flagstick.
Figure 13:
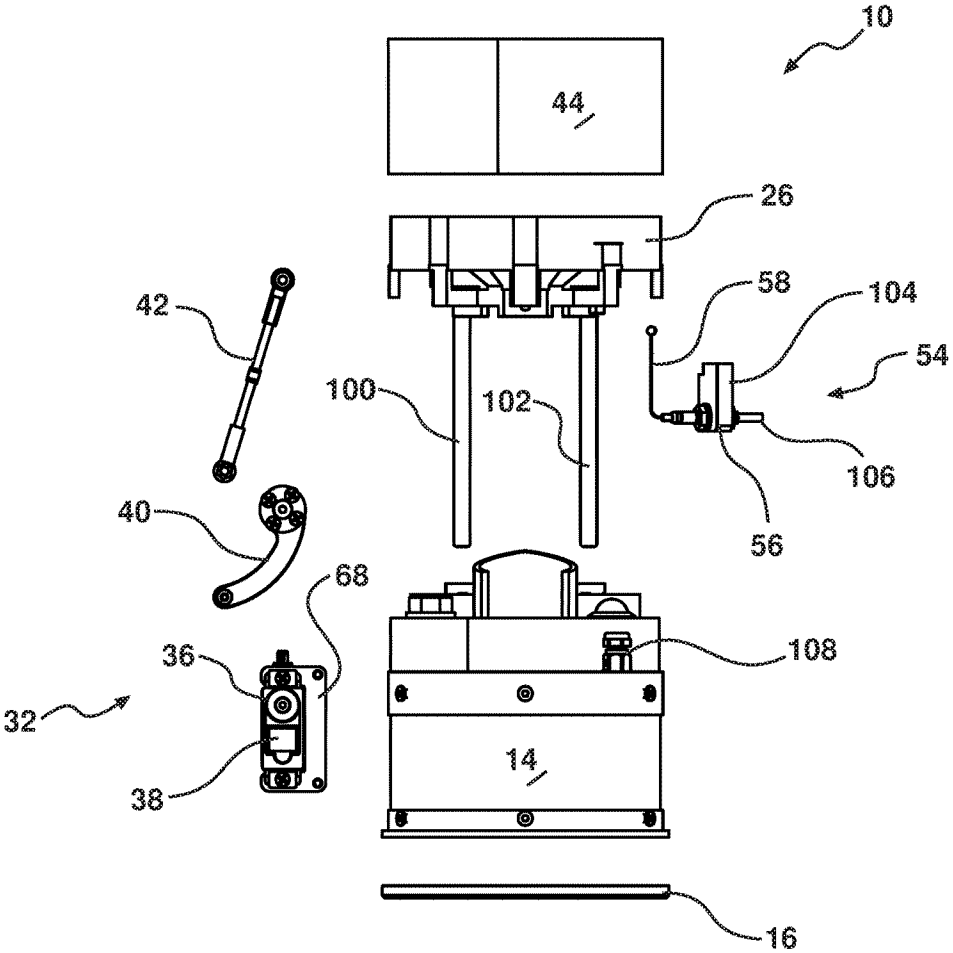
FIG. 13 is an exploded view of the advertising apparatus of FIG. 12.
Figure 12:
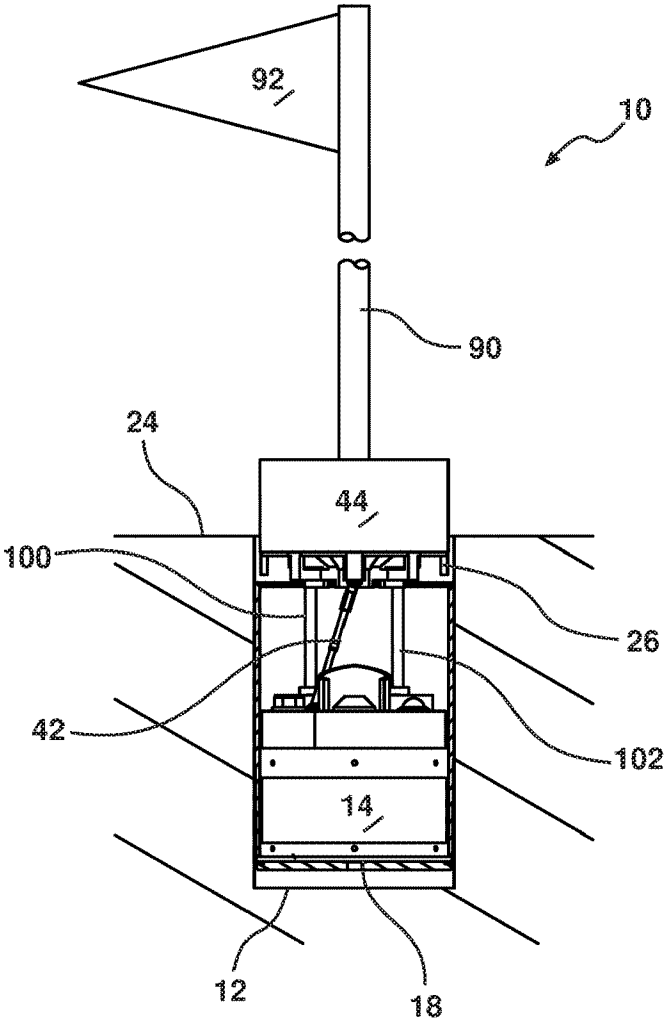
FIG. 12 is a side schematic view of another embodiment of the advertising apparatus.
Figure 15:
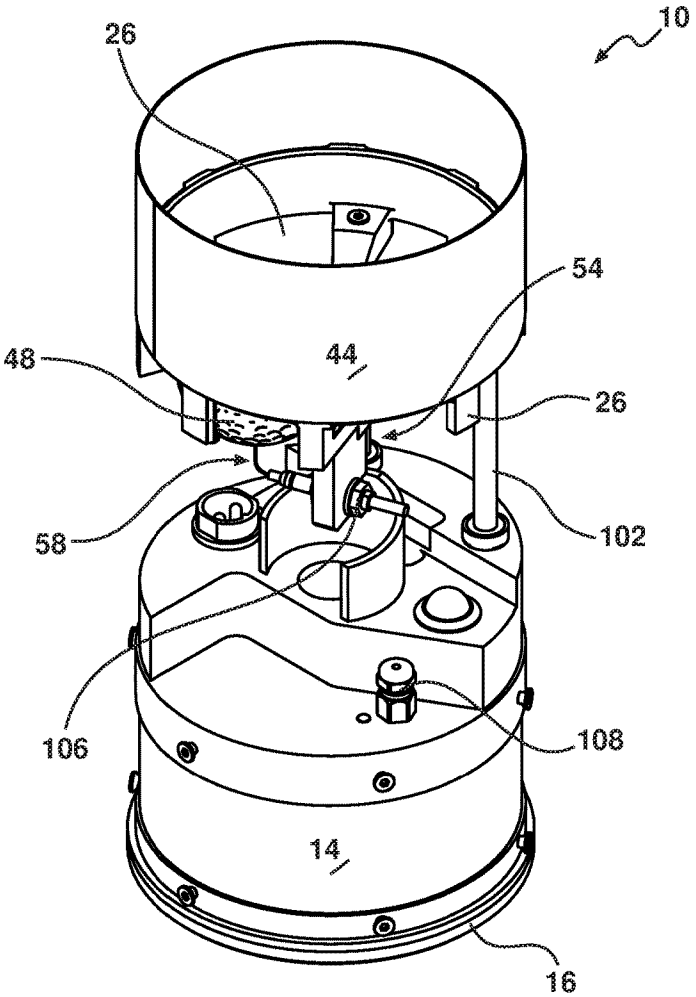
FIG. 15 is a perspective view of the advertising apparatus of FIG. 12 in a raised position.

FIG. 11 illustrates the possible position of the indicia 88 on the display support 44 whereby in the elevated position the indicia 88 are visible laterally from an outside of the golf hole and thus can be readily seen and shown, for example, to a television audience or can at least be seen by the gallery watching the event.

As further illustrated in FIG. 11, the flagstick 90 with flag 92 attached can remaining in place even when the ball support member 26 and display support 44 are in the elevate position. This is because the flagstick 90 passes through the central aperture 78 of the ball support member 26 and engages a conventional flagstick aperture 94 in the golf cup. Alternatively, the central aperture 78 may be configured to support the flagstick 90, whereby when the ball support member 26 is moved into the elevated position the flagstick 90 is also moved upwardly.

Another embodiment of the apparatus 10 is disclosed in FIGS. 12 to 24, which illustrates the apparatus 10 including a base 14 having a foot 16 that is configured to rest on the top of a baseplate 18 of the golf cup 12. The reader should however appreciate that the apparatus 10 and golf cup 12 may be unitary in construction, such that the apparatus of the present invention is used in place of a conventional golf cup.

The apparatus 10 of the present embodiment further includes a ball support member 26 rigidly attached to generally vertical shafts 100, 102 that slidably engage the base 14 and act as guide members when the ball support member 26 is moved vertically. A drive 32 is pivotably connected to the ball support member 26 and rotatably connected to mount 36 on the control member 38. In the present embodiment the drive 32 comprises a first arm 40 and second arm 42, wherein the first arm 40 is connected at a first end to the rotatable mount 36 on the control member 38 and pivotably connected to the second arm 42 at a second end thereof. A second end of the second arm 42 is pivotably connected to the ball support member 26.

Figure 14:
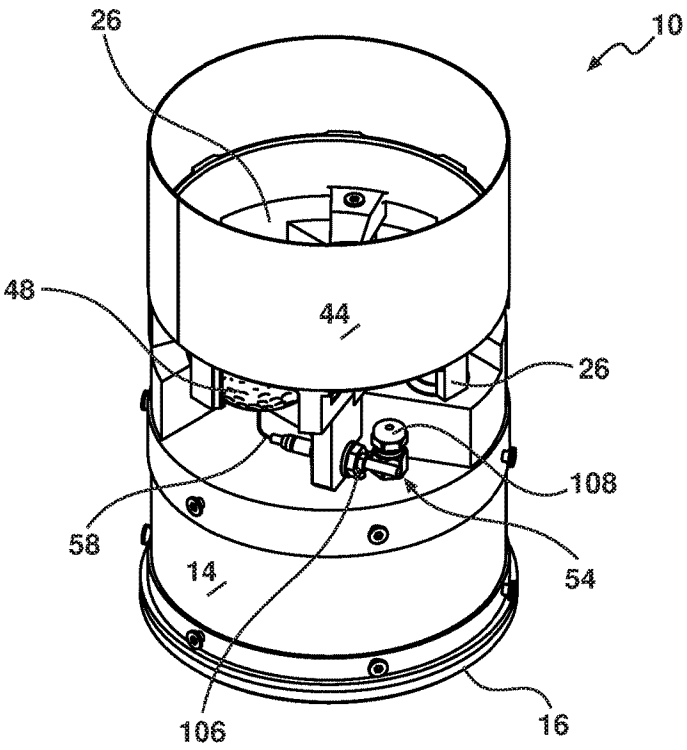
FIG. 14 is a perspective view of the advertising apparatus of FIG. 12 in a lowered position.
Figure 16:
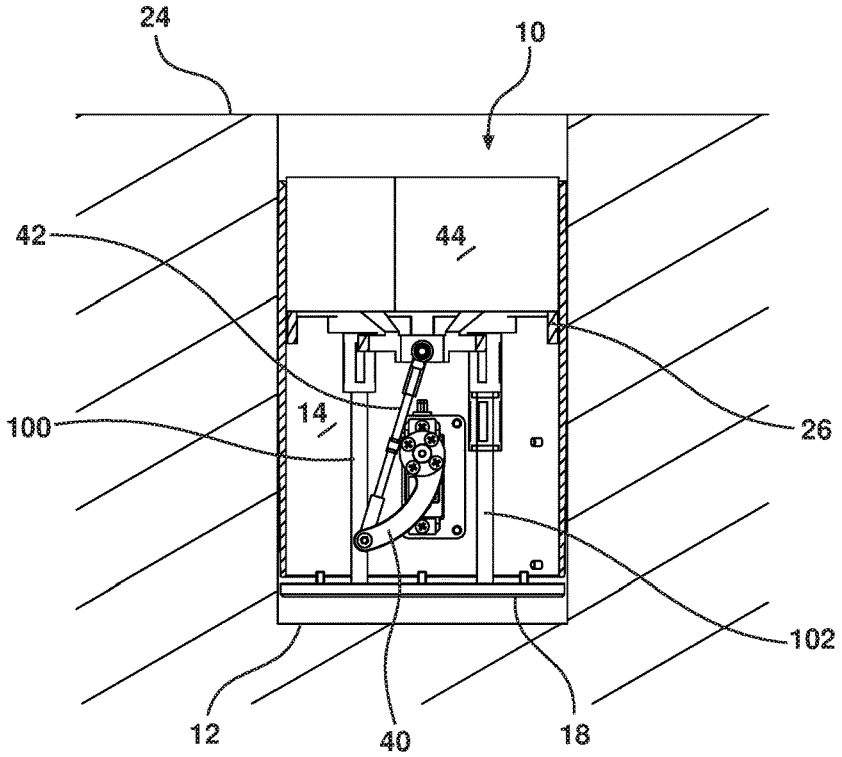
FIG. 16 is a side schematic view of the advertising apparatus of FIG. 12 in a lowered position.
Figure 17:
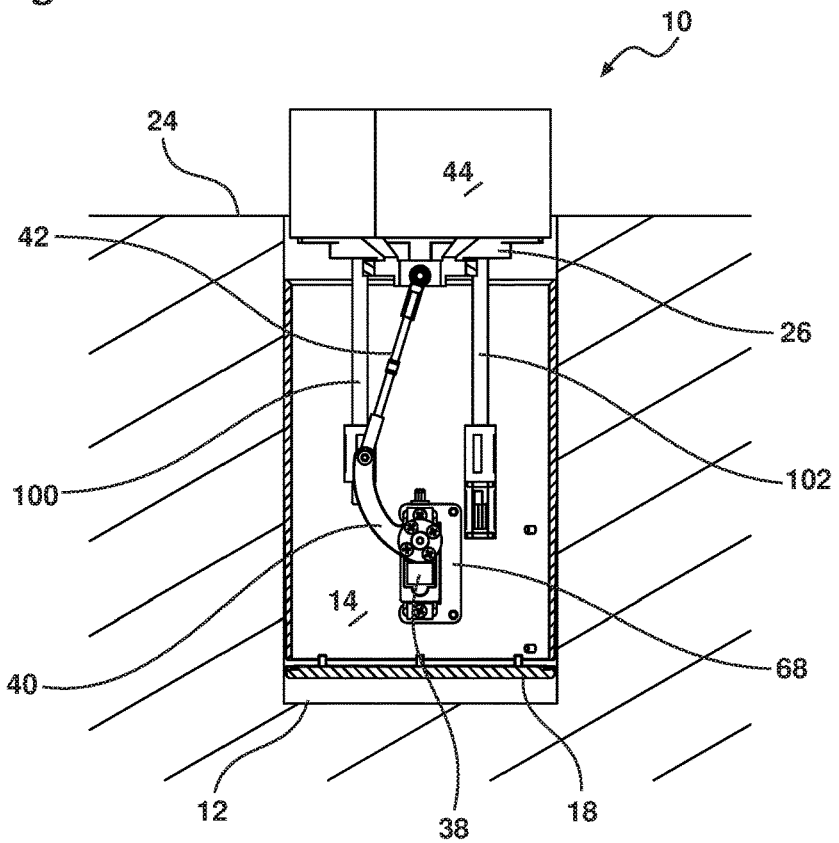
FIG. 17 is a side schematic view of the advertising apparatus of FIG. 12, in a raised position.
Figure 19:
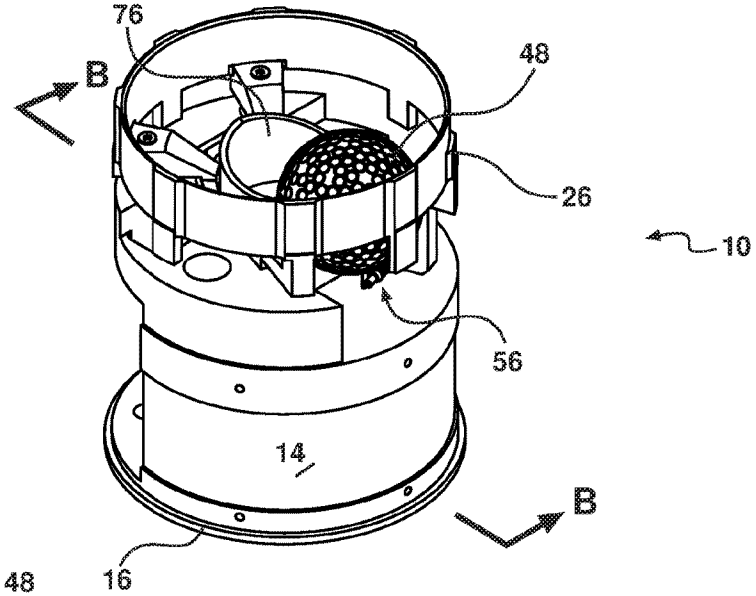
FIG. 19 is a reverse perspective view of the advertising apparatus of FIG. 18, in a lowered position with a golf ball contacting the sensor and the display support removed.
Figure 21:
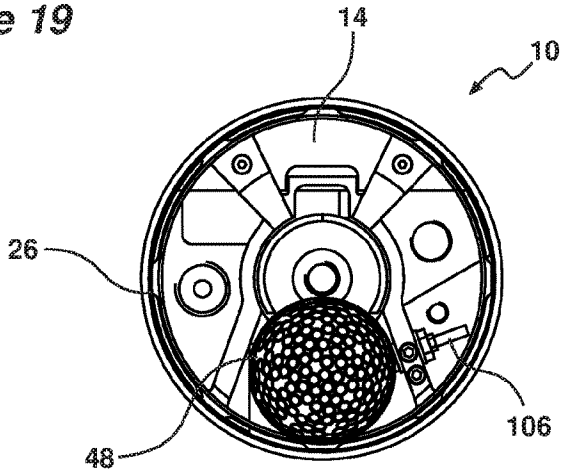
FIG. 21 is a top view of the advertising apparatus of FIG. 19, with a golf ball located therein at the induced position.
Figure 20:
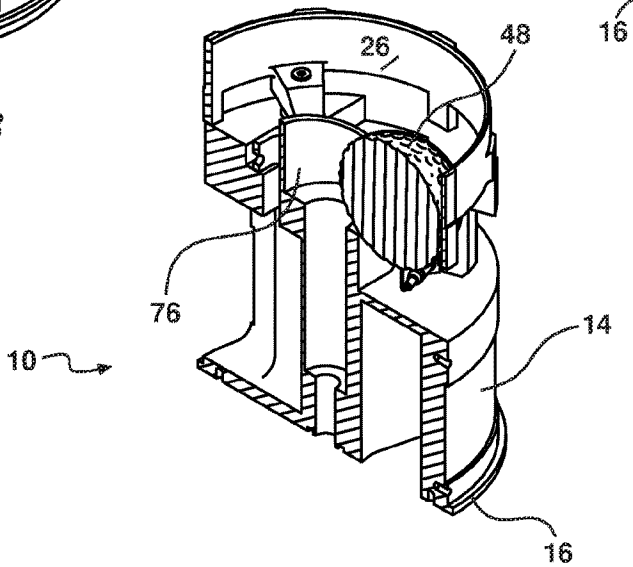
FIG. 20 is a perspective cross-sectional view through B-B of the advertising apparatus of FIG. 19.
Figure 18:
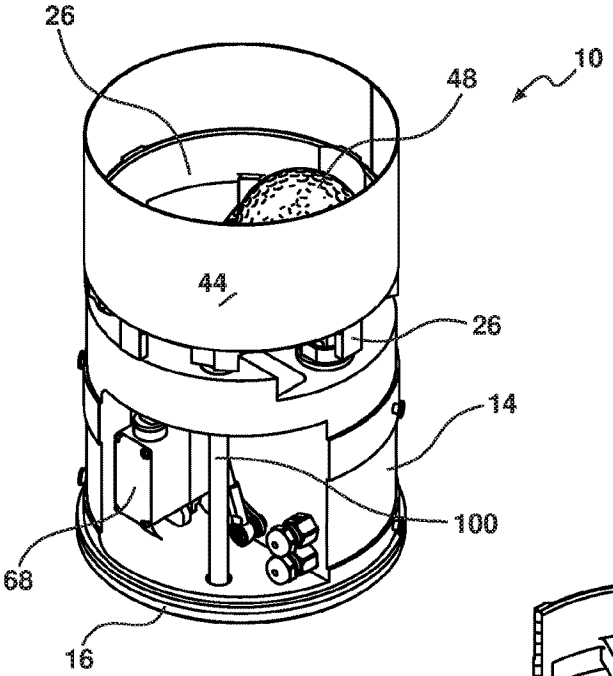
FIG. 18 is a perspective of the advertising apparatus of FIG. 12, in a lowered position with a golf ball in the induced position.
Figure 23:
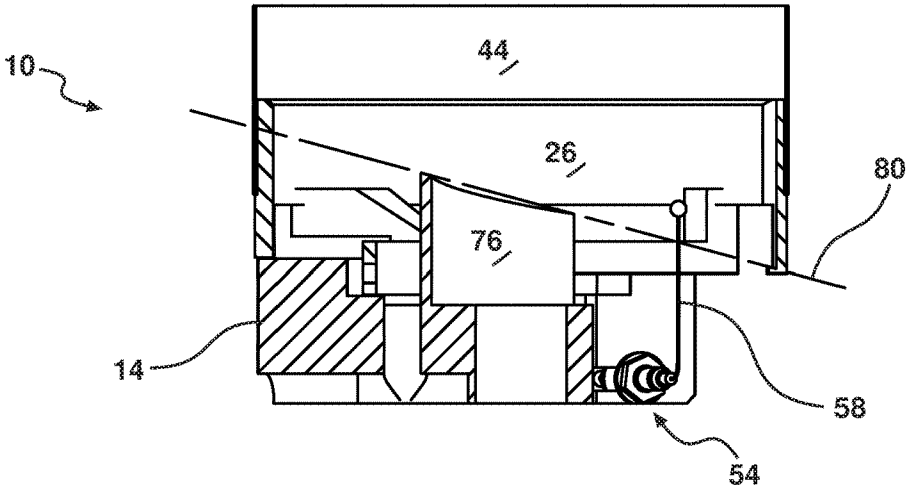
FIG. 23 is a cross-sectional view through B-B of the ball support member of FIG. 19 illustrating the plane of one embodiment of the inclined guide with a single sensor.
Figure 24:
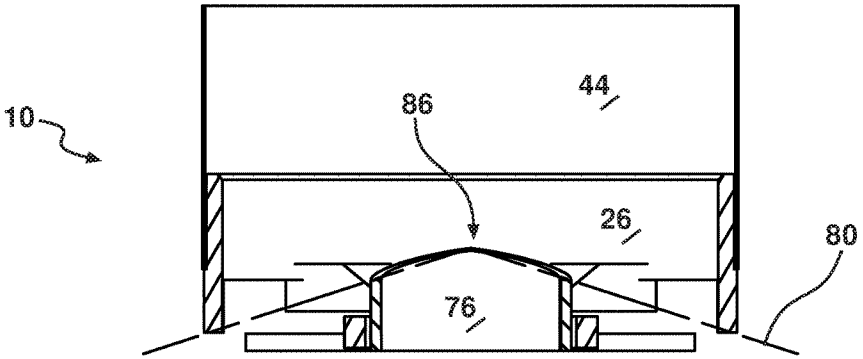
FIG. 24 is a side cross-sectional view of ball support member of FIG. 19 illustrating the apex of the inclined guide.
Figure 22:
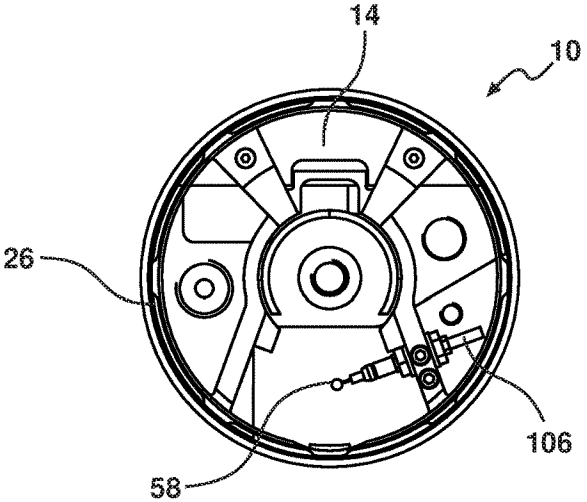
FIG. 22 is a top view of the advertising apparatus of FIG. 19, illustrating the position of the sensor with the golf ball removed.

The sensor 54 is connected to mounting plate 104, to which is also mounted switch 106, that controls the operation of the motor when the ball support member 26 is being retracted by contact with the projection 108, as illustrated in FIG. 14.

Figure 25:
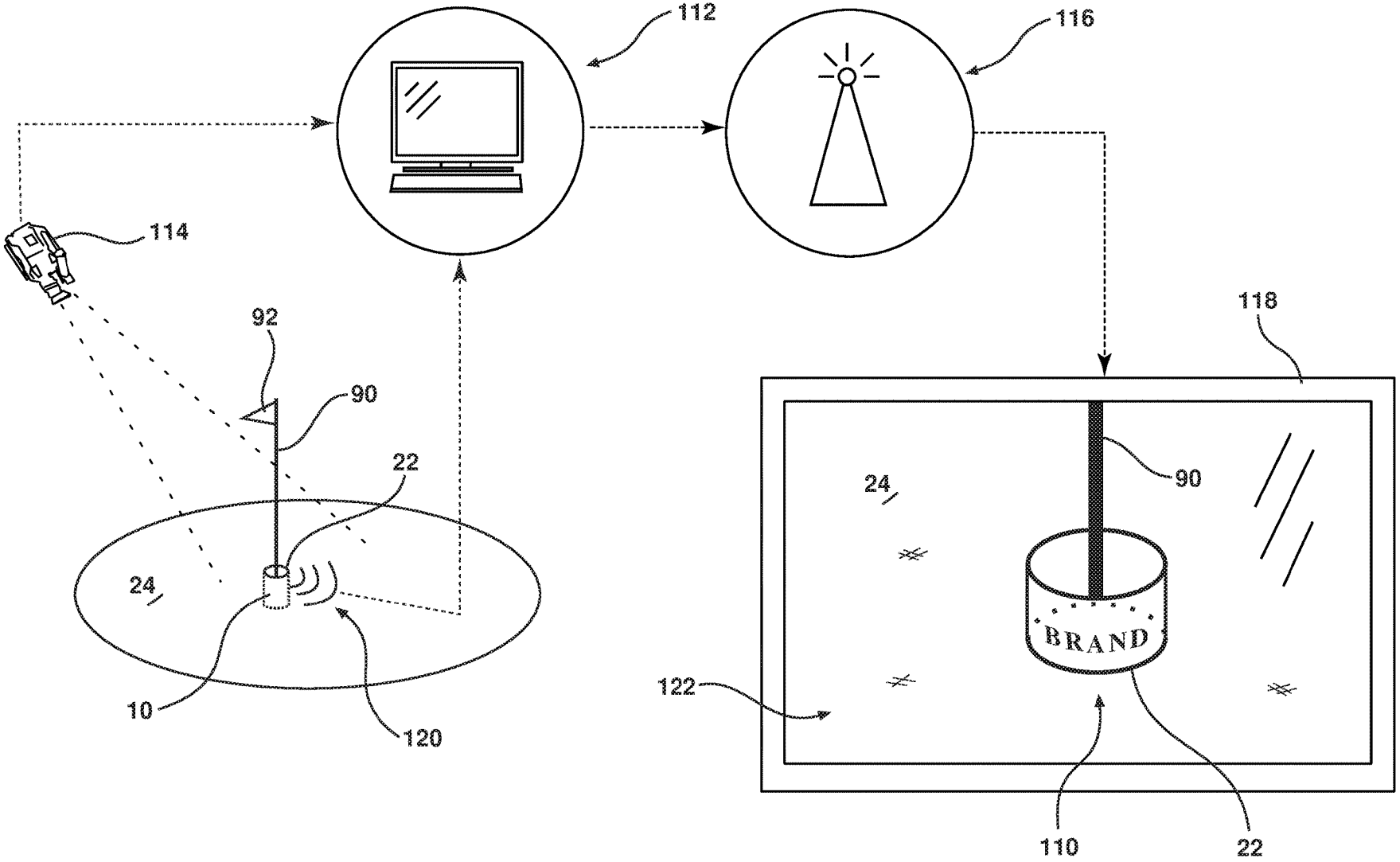
FIG. 25 is a schematic view of a virtual advertising system for use in relation to a golf hole.

In another embodiment, as illustrated in FIG. 25, the advertising display may be virtual advertising 110 that is displayed in proximity to a golf hole 22 on a display screen of a controller 112 from footage captured by a camera 114, when the golf ball 48 enters the golf hole 22. This advertising is therefore able to be incorporated into the televised broadcast footage 116 for display on televisions and display screens 118.

The present embodiment includes the features of the immediately preceding embodiments of the apparatus, but with a transmitter 120 used in the place of the display support 44. Accordingly, when the sensor 54 located within a golf cup 12 registers the presence of a golf ball 48 the transmitter 120 is configured to transmit a signal that is processed by the controller 112, wherein the advertising image 110 is overlayed over video footage 122 of the golf course green 24, which can then be broadcast.

The advertising image 110 may be a static image, a series of static images or an overlaying video on the video footage of the golf course green.

Figure 26:
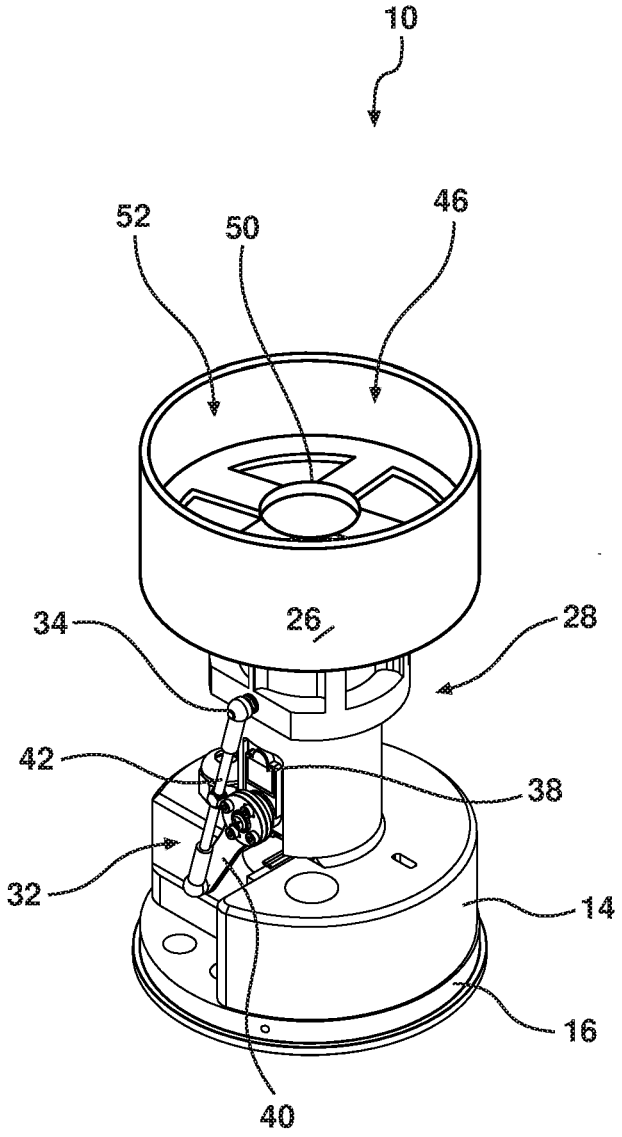
FIG. 26 is a perspective view of one embodiment of an automatic ball raising assembly.
Figure 27:
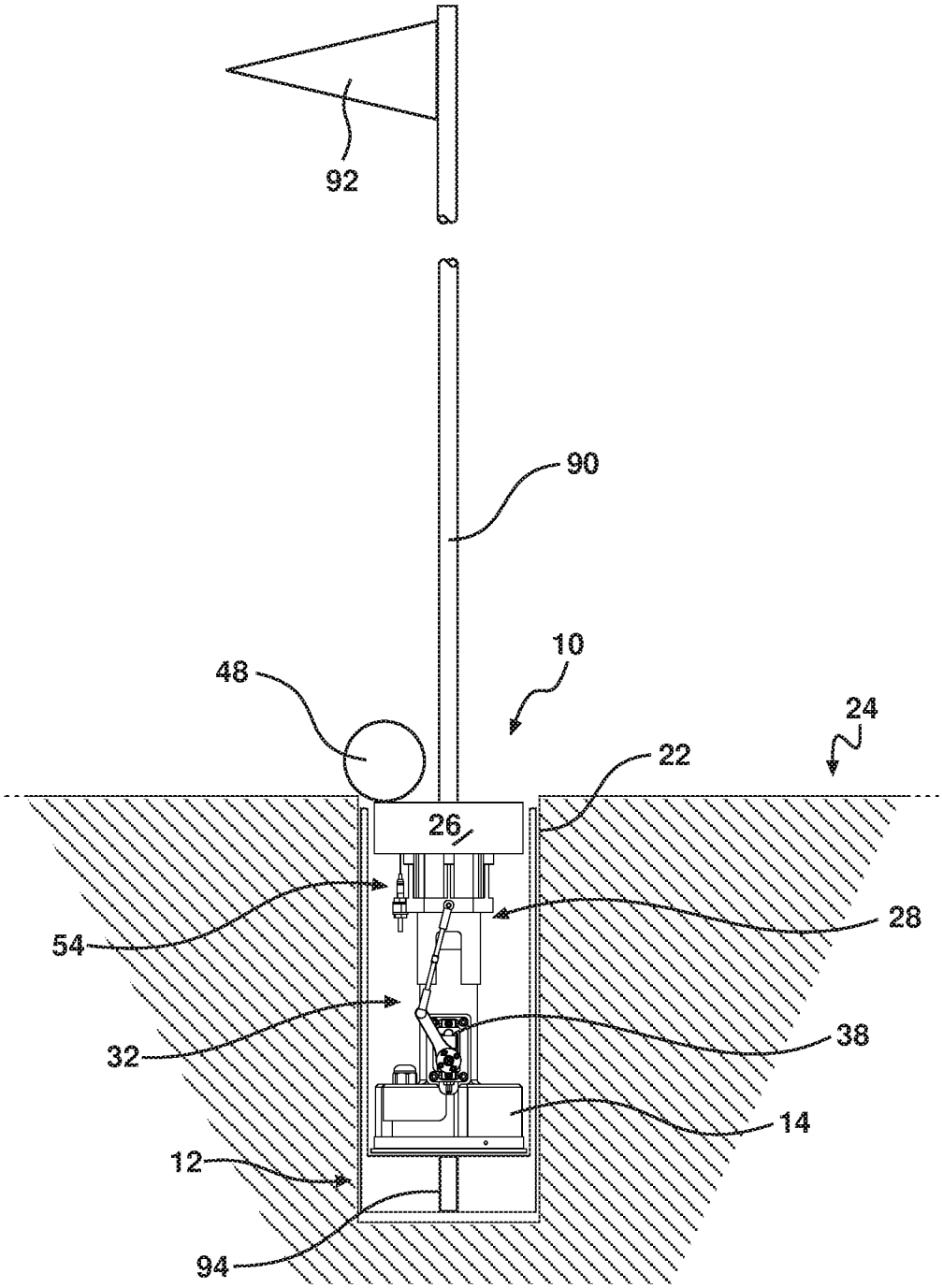
FIG. 27 is a schematic view of the automatic ball raising assembly of FIG. 26, positioned within a golf hole.
Figure 28:
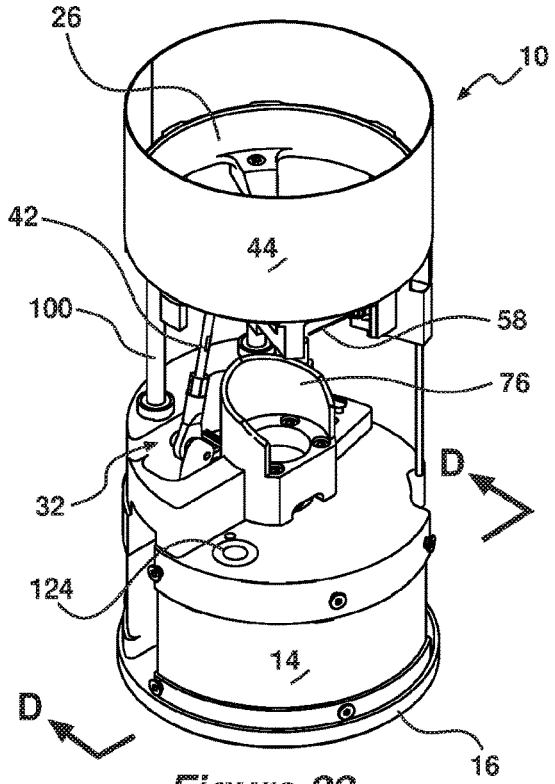
FIG. 28 is a perspective view of a further embodiment of the advertising apparatus.
Figure 29:
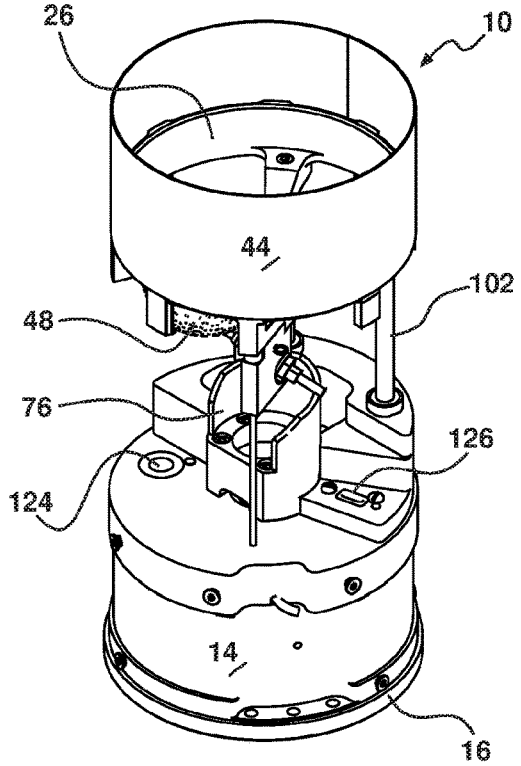
FIG. 29 is an opposite perspective view the advertising apparatus of FIG. 28.
Figure 30:
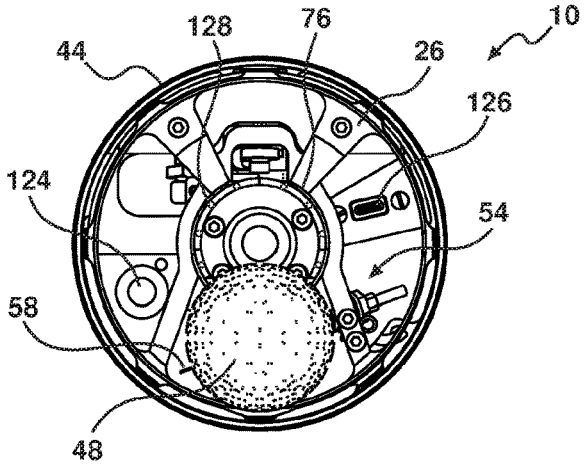
FIG. 30 is a top view of the advertising apparatus of FIG. 29.
Figure 31:
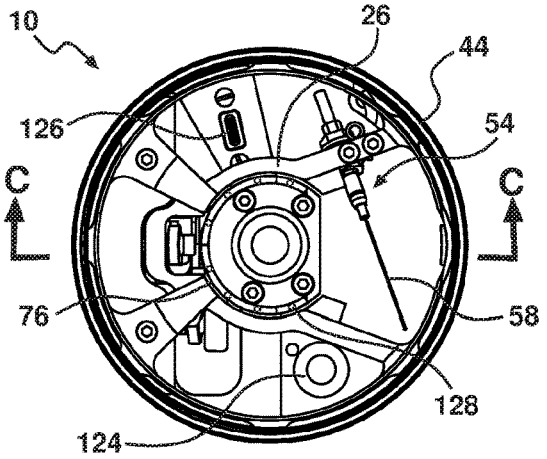
FIG. 31 is a top view of the advertising apparatus of FIG. 28.
Figure 32:
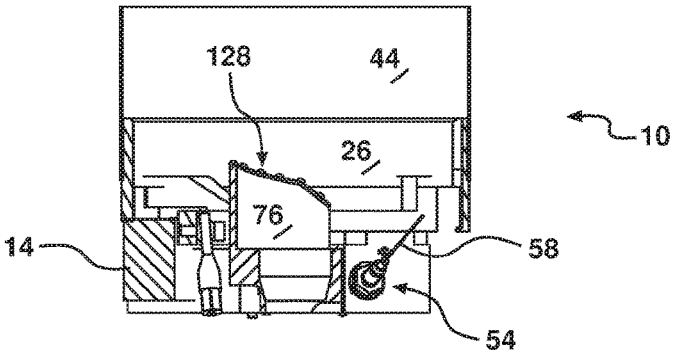
FIG. 32 is a cross-sectional view through C-C of FIG. 31.
Figure 33:
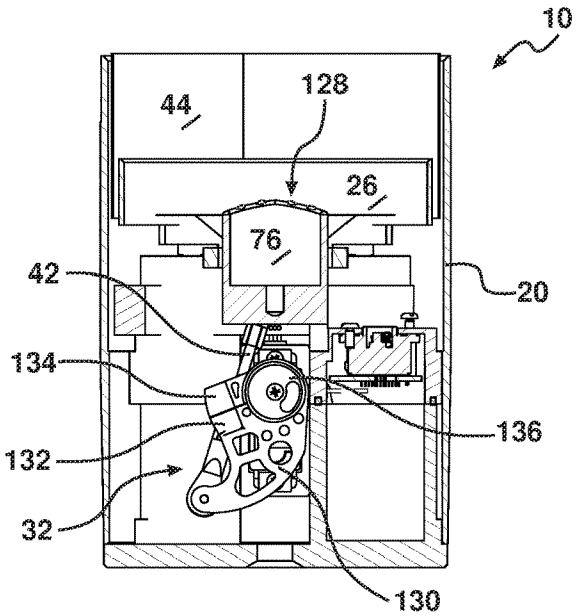
FIG. 33 is a cross-sectional view through D-D of FIG. 28, illustrating the drive with overload mechanism in a lowered arrangement.

In yet another embodiment, as illustrated in FIGS. 26 and 27, the apparatus 10 may comprise a ball raising assembly for a golf cup 22. The ball raising assembly is substantially the same of the preceding embodiments, but without the display support 44 attached to the ball support member 26. The ball raising assembly of the present invention may be used in conjunction with the virtual advertising 110, as previously discussed. The present embodiment would inhibit a player from damaging the grass surrounding the top of the hole, whilst retrieving either ball, and would assist older players.

In still another embodiment, FIGS. 28 to 32 illustrate an alternate configuration of the apparatus 10, which includes a generally straight contact shaft 58 of the contact sensor 54. The operation of the contact shaft 58 is the same as previously discussed, however in the present embodiment the contact shaft 58 has greater clearance and is inhibited from catching on the edge of the ball support member 26. The apparatus 10 further includes a sealed push button switch 124 with rubber boot. The push button switch 124 is used to change the modes of the apparatus and to turn the device On and Off. A USB recharge port 126 is also proved to recharge the internal battery (not shown). The USB recharge port 126 preferably includes a flexible cover, although this is not shown in the figures.

As further illustrated in FIGS. 30 to 35, the inner guide member 76 includes beads 128 of resiliently deformable material applied to an upper surface. These beads 128 act to inhibit the ball from bouncing out of the golf hole when no flag is installed. The beads 128 could be understood to act as 'bounce attenuation' for the golf ball. In one embodiment, small beads of silicone are applied to the top of the the inner guide member 76. The reader should however appreciate that the beads could be place at other locations within the apparatus, to act as a cushion to inhibit the ball from bounce against a hard surface. The beads 128 may be applied by hand, printed or otherwise formed on any of the internal hard surfaces of the apparatus 10.

The reader will appreciate that the apparatus 10 draws a small amount of power and will typically not be required to be turned On and Off, when positioned in the golf hole. However, it is preferably to turn the apparatus 10 Off during transport to prevent it from being unintentionally activated and possibly damaged. In one embodiment there are three modes envisaged:

Mode 1—wherein upon activation by a golf ball 48, the ball support member 26 remains in a raised position until the golf ball 48 is removed;

Mode 2—wherein upon activation by a golf ball 48, the ball support member 26 moves up and remains in a raised position for a set period of time, whereafter it moves back into the lowered position, with the golf ball 48 remaining therein; and Mode 3—rest or Off mode.

Figure 34:
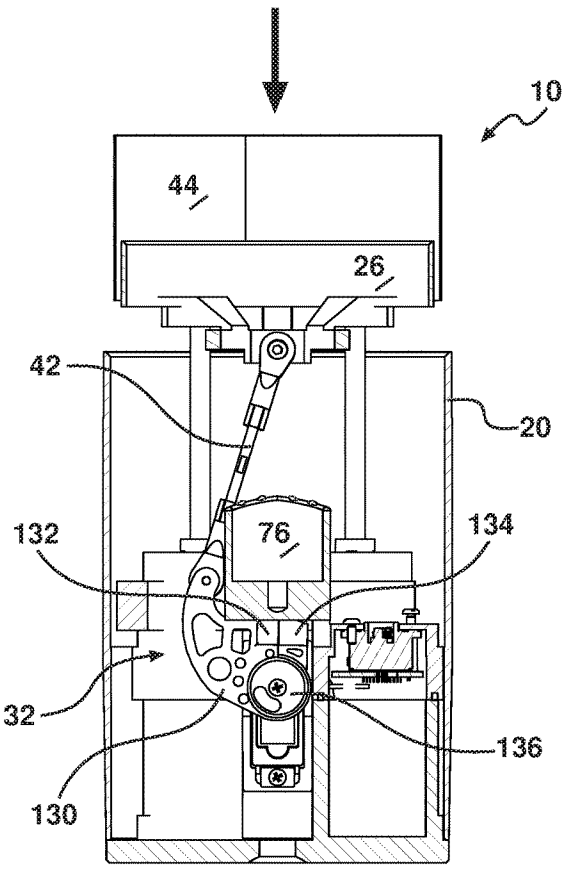
FIG. 34 is a cross-sectional of FIG. 33, illustrating the drive with overload mechanism in a raised arrangement.

The drive 32 in a preferred embodiment includes an overload mechanism comprising a decouplable arm portion 130 which is coupled to a rotary body 136, as illustrated in FIGS. 33 to 40. The decouplable arm portion 130 includes a primary portion 132 which includes a first magnet and a secondary portion 134 which includes a second magnet. An end of the primary portion 132 is pivotably coupled to the second arm 42, as best illustrated in FIG. 34.

Figure 35:
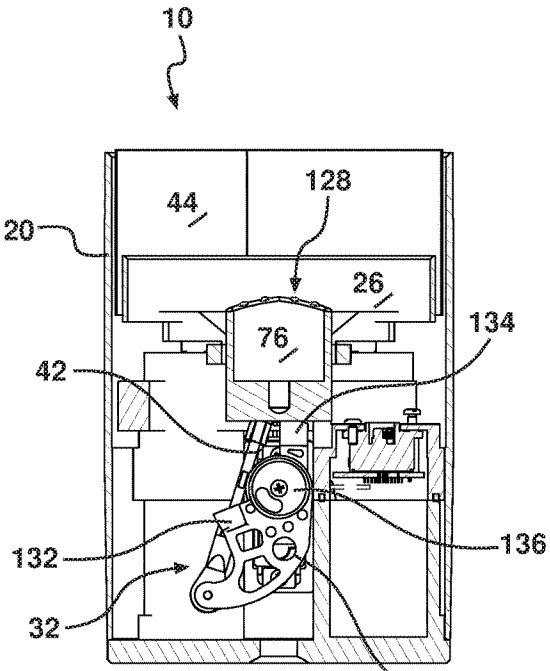
FIG. 35 is a cross-sectional of FIG. 33, illustrating the overload mechanism in a trapped condition and the drive in a lowered arrangement.

The primary portion 132 is independently rotatably coupled to the rotary body 136 and the secondary portion 134 is fixed to the rotation of the rotary body 136. Under normal conditions the respective magnets hold the primary portion 132 and secondary portion 134 in a fixed arrangement relative to each other. When a threshold of downward pressure is applied to the ball support member 26 or display support 44, in the direction of the arrow in FIG. 34, the magnetic attraction between the first and second magnets is overcome. The primary portion 132 is then configured to move independently from the secondary portion 134, around the rotary body 136, into the lowered position, as illustrated in FIG. 35. This overload mechanism protects the motor and other mechanical components of the apparatus from being damaged due to misuse or accidental contact. For instance, if a person pushes down on the ball support member 26 when in the raised position, or an obstacle is placed over the hole when in the lowered position, the overload mechanism will be triggered to thereby protect the apparatus 10 from damage.

Figure 36:
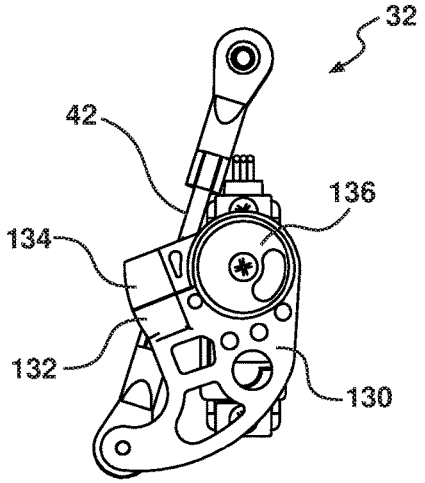
FIG. 36 is a side view of the drive of FIG. 33 in the lowered arrangement.
Figure 37:
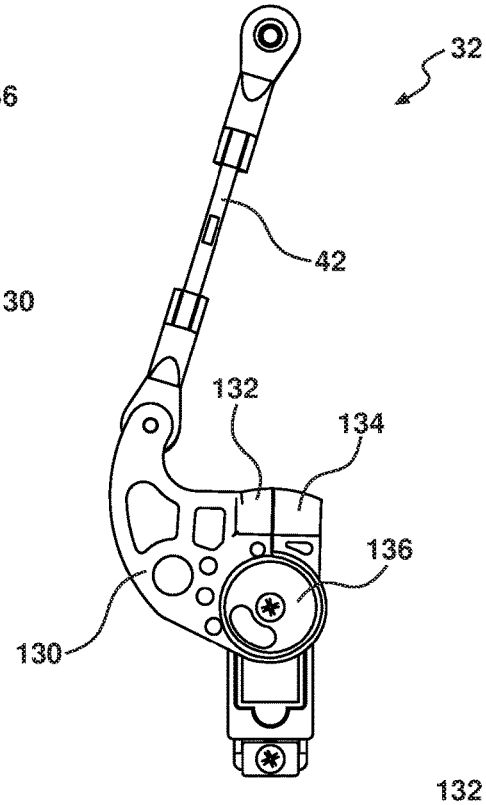
FIG. 37 is a side view of the drive of FIG. 34 in the raised arrangement.
Figure 38:
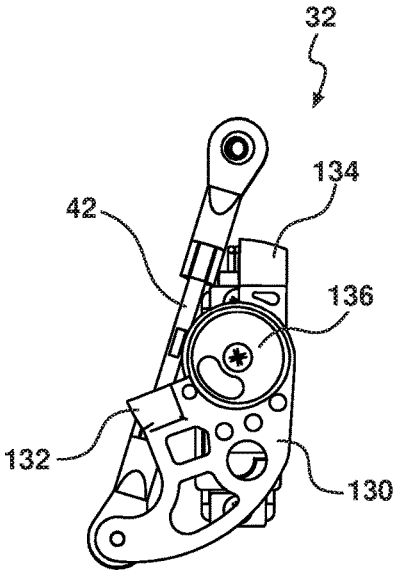
FIG. 38 is a side view of the drive of FIG. 35 in the lowered arrangement with a tripped overload mechanism.

FIGS. 36 to 38 illustrate the drive 32 isolated from many of the other components and shows the triggering of the overload mechanism in FIG. 38 and the subsequent movement of the secondary portion 134 back into the lowered position. The reader will appreciate that when the drive 32 is then operated back into the lowered arrangement, whereby the rotary body 136 and secondary portion 134 attached thereto are rotated back into the lowered position, the magnets of the primary and secondary portions 132, 134 are magnetically coupled, as shown in FIG. 36. The drive 32 can then continue its normal operation until another trigger event occurs.

Figure 39:
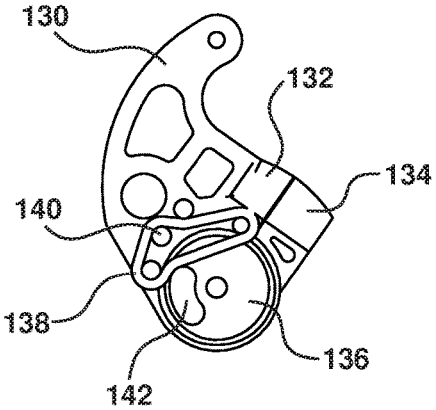
FIG. 39 is another embodiment of the overload mechanism, in a working position, including a biasing member to dampen the overload mechanism.
Figure 40:
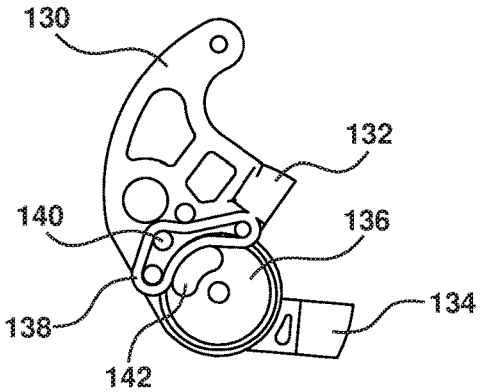
FIG. 40 is the overload mechanism of FIG. 39, in a tripped position.

As illustrated in FIGS. 39 and 40, a flexible band 138 is positioned around projections 140 on the primary portion 132. The flexible band 138 is configured to bear against a raised portion 142 on the rotary body 136. The purpose of the flexible band 138 is to dampen the movement of the primary portion 132 when it magnetically decouples from the secondary portion 134 during a trigger event, such as when someone forcibly pushes down on the ball support member 26. This inhibits the primary portion 132 from dropping suddenly under the weight of the ball support member 26, which could damage the mechanism. The flexible band 138 could therefore be consider to be a dampening device to inhibit damage when a trigger event occurs.

The skilled addressee will now appreciate the many advantages of the illustrated invention. In one form the invention provides an advertising medium that utilises a previously underutilised location. Furthermore, the invention in one form provides a means of automatically lifting the golf ball to enable easier retrieval by a player, while providing valuable advertising space. In one form the apparatus may be a discrete module that can be retrofitted into existing golf cup without requiring modification thereof. The configuration of the apparatus also means that it can be used even when a flag is positioned within the golf cup.

Various features of the invention have been particularly shown and described in connection with the exemplified embodiments of the invention, however, it must be understood that these particular arrangements merely illustrate, and that the invention is not limited thereto. Accordingly the invention can include various modifications, which fall within the spirit and scope of the invention. For the purpose of the specification the word "comprise", "comprises" or "comprising" means "including but not limited to".

The invention claimed is:

1. An advertising apparatus, including:

a base being supportable within a golf cup or forming a part thereof, the golf cup being positionable within a golf hole of a golf green;

a ball support member connected to the base and movable between a retracted position and an elevated position by way of a drive;

a generally annular shaped display support fixed to an upper surface of the ball support member whereby when the ball support member is in the elevated position the generally annular shaped display support extends upwardly from the golf hole above a surface of the golf green for displaying an advertisement;

a ball guide located within the ball support member for impelling a golf ball received therein into an induced position; and a sensor located at, or adjacent, the induced position for controlling an operation of the drive to raise or lower the ball support member depending upon the presence of the golf ball; and wherein the drive includes an overload mechanism comprising a decouplable arm portion, which is couplable to a rotary body, the overload mechanism being configured to protect the advertising apparatus from being damaged when downward pressure is applied to the ball support member or to the generally annular shaped display support member.

2. The advertising apparatus in accordance with claim 1, wherein the generally annular shaped display support comprises a vertically planar strip of material which is wrapped to form a circular portion and is attached to the ball support member, wherein the advertisement is printed onto the strip of material, or affixed thereto, or the advertisement is projected thereonto.

3. The advertising apparatus in accordance with claim 1, wherein the sensor is activated by the presence of the golf ball in the induced position to raise the ball support member into the elevated position wherein the generally annular shaped display support extends upwardly from the golf hole above the surface of the golf green.

4. The advertising apparatus in accordance with claim 3, wherein upon removal of said golf ball, the sensor activates the drive to move the ball support member from the elevated position into the retracted position, wherein the generally annular shaped display support is located substantially within the golf cup and below the surface of the golf green.

5. The advertising apparatus in accordance with claim 3, wherein the sensor comprises a contact sensor, or a light beam source and a light detector assembly.

6. The advertising apparatus in accordance with claim 1, wherein the generally annular shaped display support includes a blue screen or another coloured surface, for use in virtual overlaying of advertising on the generally annular shaped display support within a broadcast environment, or the generally annular shaped display support includes a plurality of light emitting diodes (LEDs) to provide either a dynamic or static display.

7. The advertising apparatus in accordance with claim 1, wherein the drive comprises a first arm that is rigidly connected at a first end to a rotatable mount on a control member and pivotably connected to a second arm at a second end thereof, and a second end of the second arm being is pivotably connected to a fixed mounting point on the elevatable ball support member.

8. The advertising apparatus in accordance with claim 1, wherein the drive includes a rack and pinion assembly, or the drive includes at least one biasing spring having a stop to limit the elevation of the generally annular shaped display support, and a catch means to capture the generally annular shaped display support to move the generally annular shaped display support into the retracted position against the bias of the spring, or the drive includes a screw threaded member, such that a motor rotates the rotatable screw threaded member to thereby facilitate the elevation.

9. The advertising apparatus in accordance with claim 1, wherein the decouplable arm portion includes a primary portion having a first magnet, and a secondary portion including a second magnet, whereby when a sufficient downward pressure is applied to the ball support member or the generally annular shaped display support, the magnetic attraction between the first magnet and the second magnet magnets is overcome and the primary portion is triggered to detach from the secondary portion and move into a lowered position independently of the secondary portion.

10. A golf cup having an elevatable display support being movable between a retracted position and an elevated position, wherein when in the elevated position the elevatable display support extends upwardly from within a golf hole above a surface of the playing surface, when a ball enters the golf cup; wherein the golf cup includes a drive configured to move the elevatable display support between the retracted position and the elevated position, and wherein the drive includes an overload mechanism comprising a decouplable arm portion, which is coupled to a rotary body, the overload mechanism being configured to protect the elevatable display support when downward pressure is applied thereto.

11. A method of presenting advertising adjacent a golf cup when a golf ball is retained therein, the method including steps of: providing a sensor in the golf cup, configured to determine the presence of a golf ball therein; and activating a physical advertising member or presenting virtual advertising overlaying a broadcast image when the golf ball is positioned within the golf cup; and providing an overload mechanism comprising a decouplable arm portion, which is couplable to a rotary body, the overload mechanism being configured to protect the physical advertising member when downward pressure is applied thereto.

* * * * *